US010392175B2

(12) United States Patent
Kinskey

(10) Patent No.: US 10,392,175 B2
(45) Date of Patent: Aug. 27, 2019

(54) WATERPROOF CONTAINER

(71) Applicant: LF Centennial Ltd., Road Town, Tortola (VG)

(72) Inventor: Terrence P. Kinskey, Marietta, GA (US)

(73) Assignee: LF CENTENNIAL LTD., Road Town, Tortola (VG)

( * ) Notice: Subject to any disclaimer, the term of this patent is extended or adjusted under 35 U.S.C. 154(b) by 0 days.

(21) Appl. No.: 15/467,445

(22) Filed: Mar. 23, 2017

(65) Prior Publication Data

US 2017/0225864 A1 Aug. 10, 2017

Related U.S. Application Data

(63) Continuation of application No. 14/506,179, filed on Oct. 3, 2014, now Pat. No. 9,637,294.
(Continued)

(51) Int. Cl.

| | |
|---|---|
| ***A45C 13/00*** | (2006.01) |
| ***B65D 6/16*** | (2006.01) |
| ***B65D 81/02*** | (2006.01) |
| ***B65D 25/06*** | (2006.01) |
| ***B65D 25/24*** | (2006.01) |
| ***B65D 25/20*** | (2006.01) |
| ***B65D 43/16*** | (2006.01) |

(Continued)

(52) U.S. Cl.

CPC ..... *B65D 81/02* (2013.01); *A45C 13/008* (2013.01); *A45C 13/02* (2013.01); *B65D 11/18* (2013.01); *B65D 25/06* (2013.01); *B65D 25/20* (2013.01); *B65D 25/22* (2013.01); *B65D 25/24* (2013.01); *B65D 43/163* (2013.01); *B65D 43/22* (2013.01); *B65D 45/20* (2013.01); *F42B 39/00* (2013.01); *A45C 2013/025* (2013.01); *B65D 2543/00175* (2013.01); *B65D 2543/00296* (2013.01); *B65D 2543/00462* (2013.01); *B65D 2543/00527* (2013.01); *B65D 2543/00546* (2013.01); *B65D 2543/00953* (2013.01); *F42B 39/26* (2013.01)

(58) Field of Classification Search

CPC ..... B65D 81/02; A45C 13/008; A45C 11/22
See application file for complete search history.

(56) References Cited

U.S. PATENT DOCUMENTS

| | | | |
|---|---|---|---|
| 2,332,245 | A | 6/1941 | Moll |
| 2,854,103 | A | 9/1958 | Henry |

(Continued)

*Primary Examiner* — Shawn M Braden
(74) *Attorney, Agent, or Firm* — Duane Morris LLP; J. Rodman Steele, Jr.; Gregory M. Lefkowitz

(57) ABSTRACT

A waterproof container is disclosed. The container can include first shell and a second shell; a first rim extending around the first shell; a second rim extending around the second shell; and a latch for securing the first shell to the second shell and defining an enclosed storage volume in a mated position. The first shell can include a grip projection adapted for opening the container from a mated position. The latch defines a latch recess adapted for receiving the grip projection when the latch secures the first shell to the second shell in the mated position. The second rim can include a continuous recess, having a pair of continuous sides and a seal ridge between, but spaced apart from, the continuous sides, while the first rim can include inner and outer continuous sealing ridges that fit over the seal ridge and between the continuous sides.

20 Claims, 44 Drawing Sheets

Related U.S. Application Data

(60) Provisional application No. 61/942,871, filed on Feb. 21, 2014.

(51) Int. Cl.

| | |
|---|---|
| ***B65D 43/22*** | (2006.01) |
| ***B65D 45/20*** | (2006.01) |
| ***F42B 39/00*** | (2006.01) |
| ***A45C 13/02*** | (2006.01) |
| ***B65D 25/22*** | (2006.01) |
| *F42B 39/26* | (2006.01) |

(56) References Cited

U.S. PATENT DOCUMENTS

| | | | | |
|---|---|---|---|---|
| 4,127,684 | A | 11/1978 | Baker | |
| 4,915,913 | A | 4/1990 | Williams et al. | |
| 4,920,771 | A | 5/1990 | Jiang | |
| 4,993,585 | A | 2/1991 | McMahon | |
| 5,127,684 | A | 7/1992 | Klotz et al. | |
| 5,806,708 | A | 9/1998 | Schwab | |
| D439,407 | S | 3/2001 | Parker | |
| D441,954 | S | 5/2001 | Parker | |
| D464,196 | S | 10/2002 | Parker | |
| D465,330 | S | 11/2002 | Parker | |
| 6,493,917 | B1 | 12/2002 | Sunka | |
| D483,948 | S | 12/2003 | Parker | |
| D485,069 | S | 1/2004 | Parker | |
| 6,698,608 | B2 | 3/2004 | Parker et al. | |
| D492,184 | S | 6/2004 | Parker et al. | |
| 6,789,692 | B2 | 9/2004 | Prezelin | |
| 6,953,126 | B2 | 10/2005 | Parker et al. | |
| 6,955,381 | B2 | 10/2005 | Parker et al. | |
| 7,533,782 | B2 | 5/2009 | Parker et al. | |
| 7,850,032 | B2 | 12/2010 | Carnevali et al. | |
| 8,893,915 | B2 | 11/2014 | Vargas | |
| 2002/0043534 | A1* | 4/2002 | Uke | A45C 5/02 220/4.21 |
| 2002/0096525 | A1 | 7/2002 | Bertoldo et al. | |
| 2003/0010783 | A1 | 1/2003 | Prezelin | |
| 2003/0111476 | A1 | 6/2003 | Serio | |
| 2003/0184199 | A1* | 10/2003 | Jananji | A47B 88/90 312/348.3 |
| 2006/0186003 | A1 | 8/2006 | Dost et al. | |
| 2008/0128428 | A1 | 6/2008 | Beckerman | |
| 2008/0286976 | A1 | 11/2008 | Chen et al. | |
| 2009/0114646 | A1 | 5/2009 | Whalen | |
| 2009/0200300 | A1 | 8/2009 | Parker et al. | |
| 2011/0127264 | A1 | 6/2011 | Whalen | |
| 2011/0147386 | A1 | 6/2011 | Whalen | |

* cited by examiner

WATERPROOF CONTAINER

CROSS-REFERENCE TO RELATED APPLICATIONS

This application is a continuation of U.S. application Ser. No. 14/506,179, filed Oct. 3, 2014, which claims priority to U.S. Provisional Patent Application No. 61/942,871, filed Feb. 21, 2014, the entirety of which is incorporated herein by reference

FIELD OF THE INVENTION

The present invention relates generally to waterproof containers.

BACKGROUND

Airtight containers can be used to keep important items, such as wallets, cell phones, ammunition, etc., dry in potentially wet environments. Such containers generally form a vacuum within the airtight container when it is closed, which makes them difficult to open. Conventional airtight containers use some form of venting feature to equilibrate the pressure inside and outside the container, which makes them easier to open.

SUMMARY

In one embodiment, a waterproof container is disclosed. The container includes a first shell and a second shell; a first rim extending around the first shell; a second rim extending around the second shell; and a latch for securing the first shell to the second shell in a mated position. An enclosed storage volume is defined by the first shell and the second shell in the mated position.

In some embodiments, the first shell includes a grip projection adapted for opening the container from a mated position, and the latch defines a latch recess adapted for receiving the grip projection when the latch secures the first shell to the second shell in the mated position.

In some embodiments, the second rim comprises a continuous recess, having a pair of continuous sides and a seal ridge between, but spaced apart from, the continuous sides; and the first rim comprises inner and outer continuous sealing ridges, where both continuous sealing ridges are between the continuous sides and on opposite sides of the seal ridge in the mated position.

In some embodiments, the second shell comprises one or more coupling members on an interior wall, and one or more dividers can be removably mounted to the coupling members. The dividers can include engaging portions to removably engage with the coupling members on the second shell. In some embodiments, the container can include a set of coordinating dividers.

These and other features, objects and advantages of the present invention will become more apparent to one skilled in the art from the following description and claims when read in light of the accompanying drawings.

DETAILED DESCRIPTION

Figure 1:
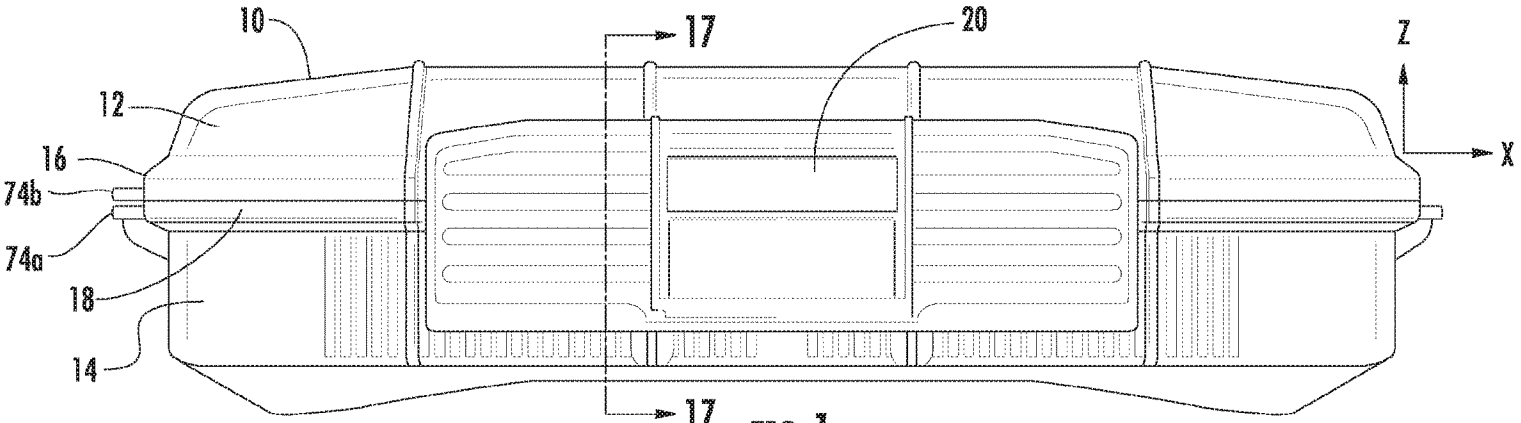
FIG. 1 is a front view of a waterproof container in the closed and locked position as described herein in the locked configuration.

A waterproof container 10 is disclosed. The waterproof container 10 is ruggedly constructed to prevent cracking. This reduces the likelihood the contents of the container 10 from being damaged, especially by water intrusion, should the waterproof container be dropped or otherwise impacted by an object. In addition, because of its unique construction the waterproof container will float and is waterproof to a depth of at least 50 feet, at least 75 feet, or at least 100 feet. In contrast, conventional vented "waterproof" containers leak at less than 50 feet (e.g., approximately 25 feet).

As shown in FIGS. 1-50, the waterproof container 10 includes a first shell 12 and a second shell 14, with a first rim 16 extending around the first shell 12 and a second rim 18 extending around the second shell 14. A latch 20 is coupled to waterproof container 10 for securing the first shell 12 to the second shell 14 in a mated position, as shown in FIG. 1. As shown in FIG. 4, an enclosed storage volume 22 is defined by the first shell 12 and the second shell 14 in the mated position. As used herein, "mated position" refers to a position where the first and second rims 16, 18 are completely engaged and the latch 20 is in the locked position, as shown in FIG. 1.

Figure 2:
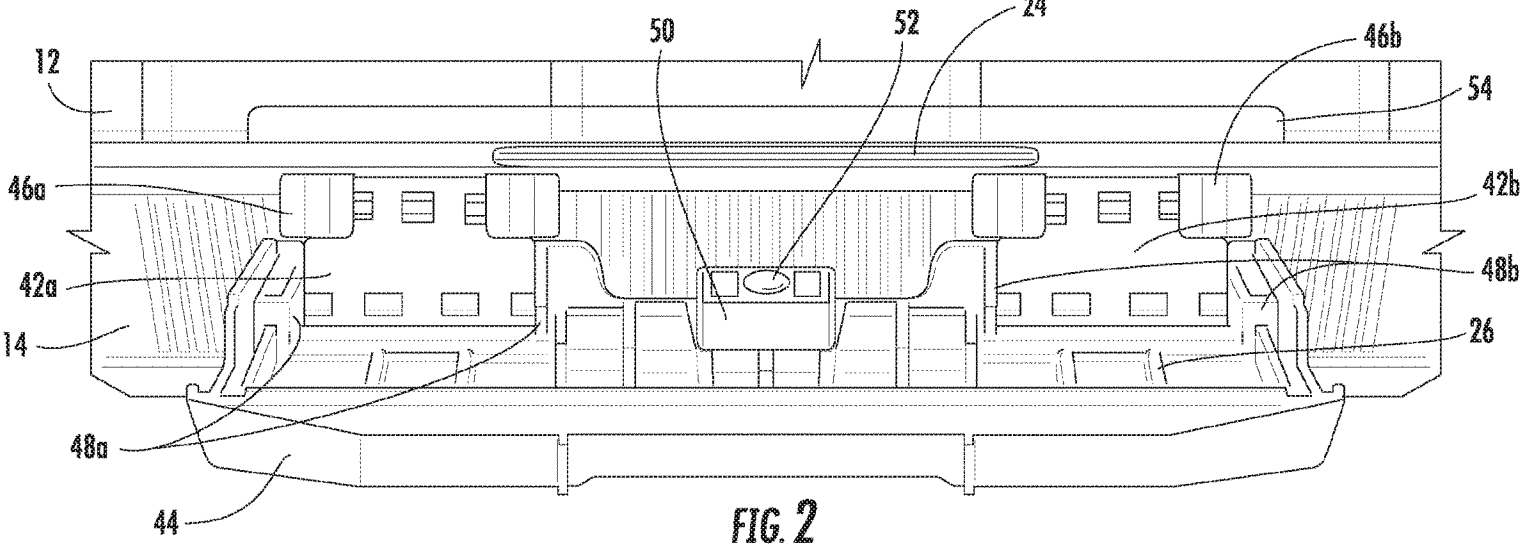
FIG. 2 is a front view of the waterproof container with the latch in the open position.

In some embodiments, the first shell 12 comprises a grip projection 24 adapted for opening the container 10 from a mated position. The latch 20 can define a latch recess 26 adapted for receiving the grip projection 24 when the latch 20 secures the first shell 12 to the second shell 14 in the mated position. As shown in FIG. 2, the latch recess 26 can completely cover the grip projection 24 from the front when the latch is locked. The grip projection 24 can extend laterally a portion of the width of the container 10 and project longitudinally forward from the first rim 16. The grip projection 24 can project longitudinally forward a sufficient distance so that, when the container 10 is in the closed position with the latch 20 open, the user can rest their fingers on top of the first shell 12 and slide the thumb under the grip projection 24 then lift the first shell 12 to open the waterproof container 10 without the need for separate venting. Without the grip projection 24 it can become necessary to wedge an object (e.g., a screw driver or finger nail) between the rims 16, 18 to break the vacuum seal and open the container 10.

In some embodiments, the container 10 also includes a mat 25 that rests at the bottom of one of the shells 12, 14. The mat 25 can be flexible or rigid.

As used herein, "laterally" is labeled as the X-axis and refers to the width of the container when viewing the front of the container. As used herein, "longitudinally" is labeled as the Y-axis and refers to the depth of the container from front to back. As used herein, "vertical" is labeled as the Z-axis and refers to the height of the container.

Figure 3:
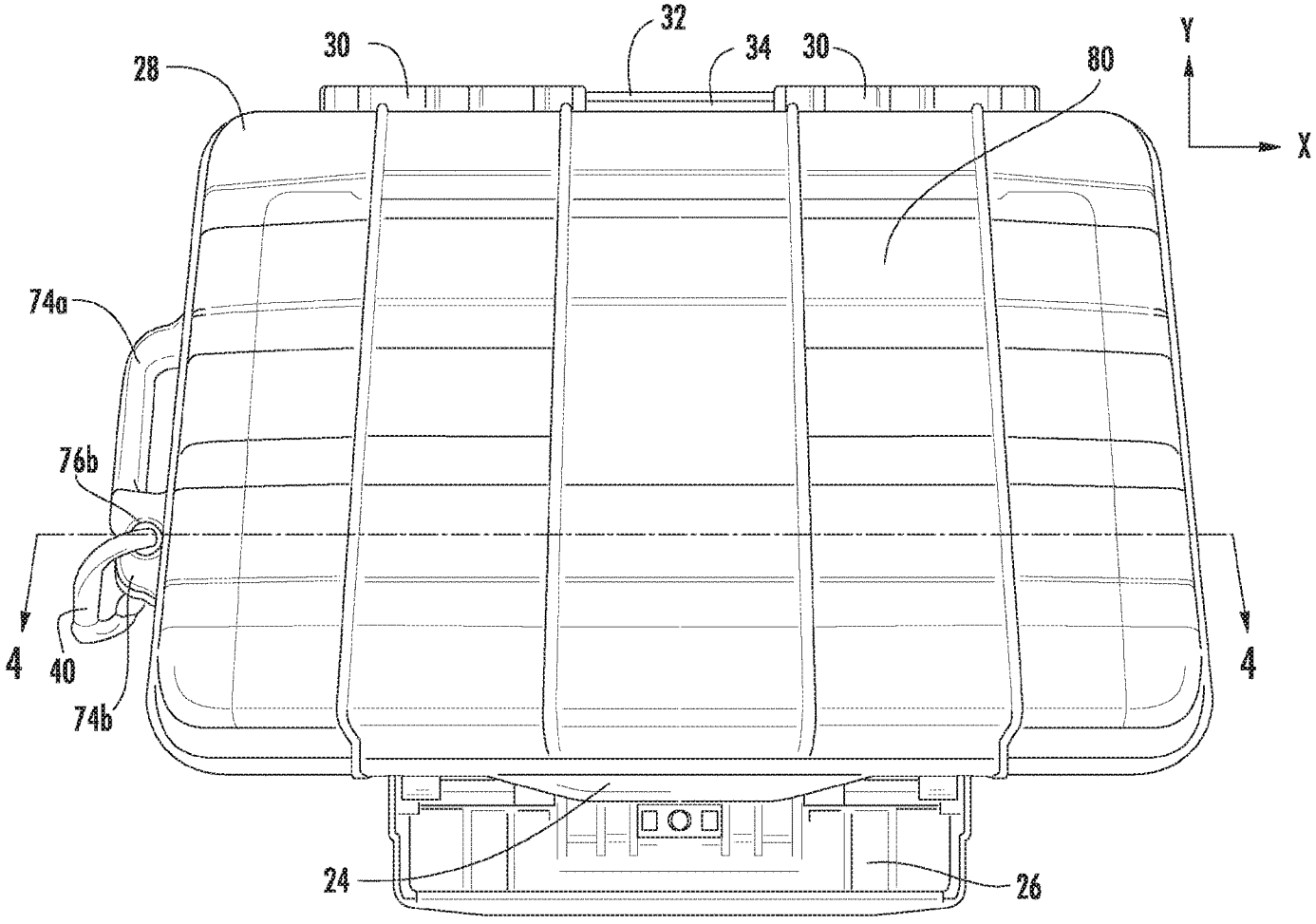
FIG. 3 is a top view of the waterproof container in the mated position with the latch in the open position.
Figure 4:
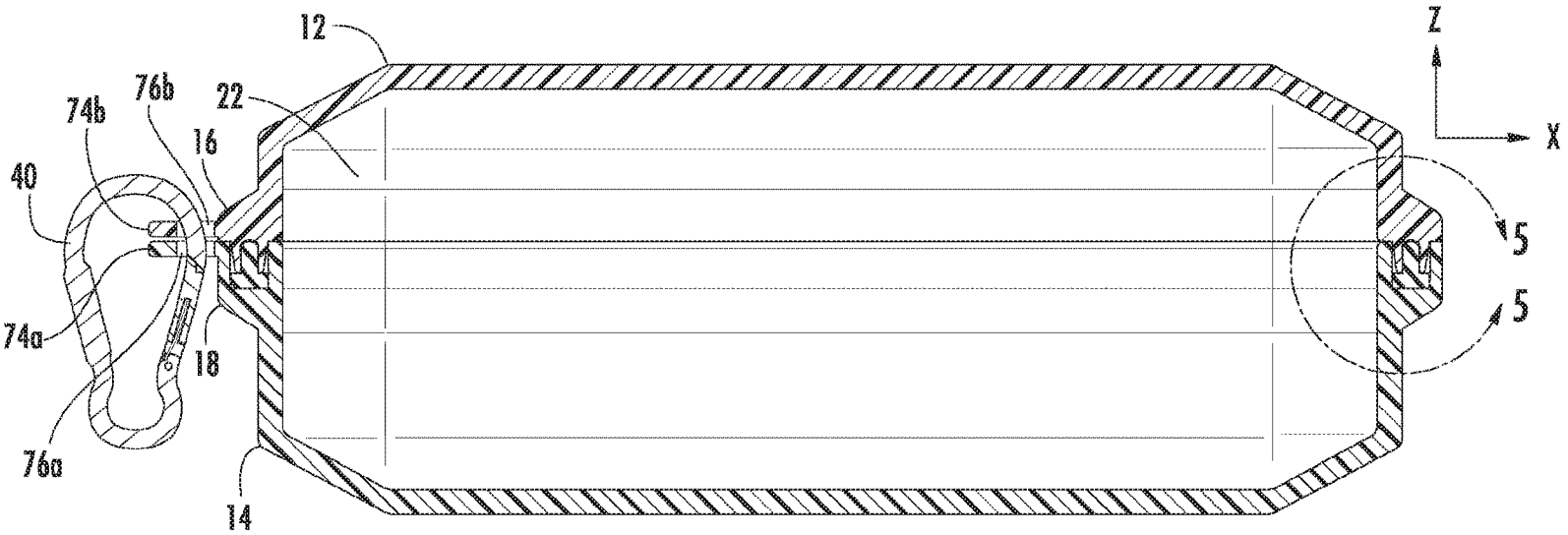
FIG. 4 is a cross-sectional view of the waterproof container of FIG. 3 taken along cut-line 4-4.
Figure 6:
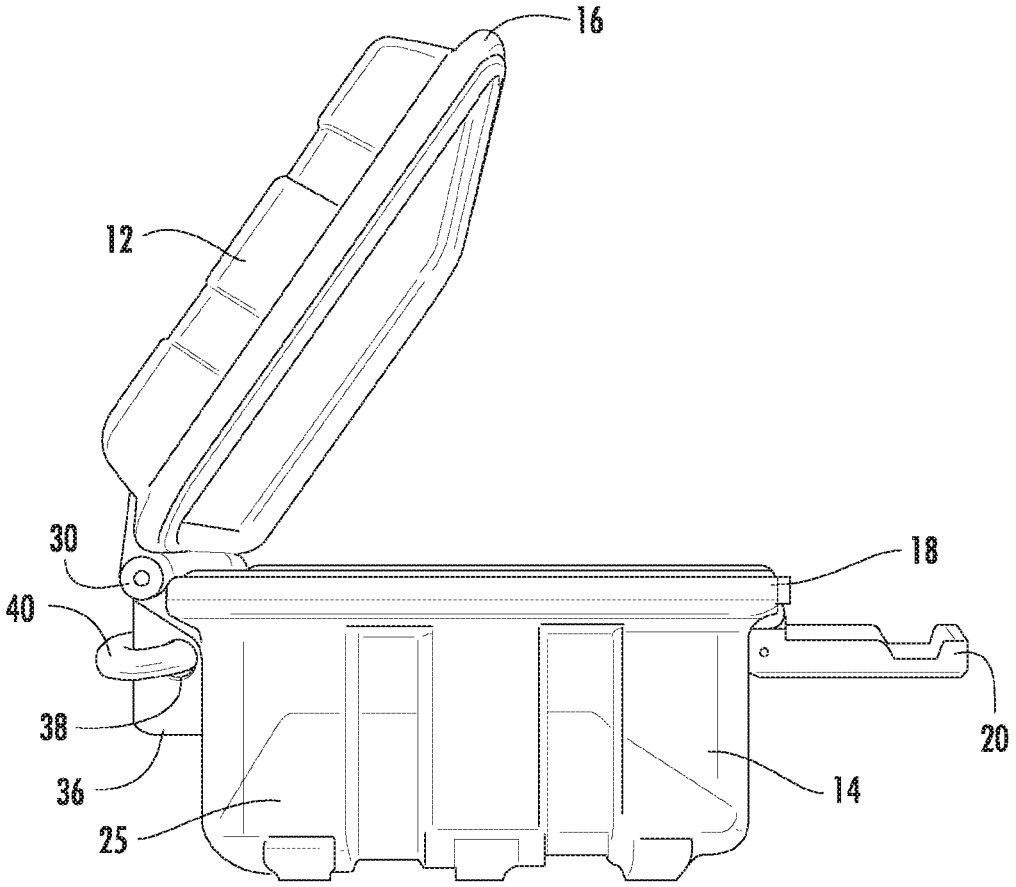
FIG. 6 is a side view of a waterproof container as described herein in an open position.
Figure 7:
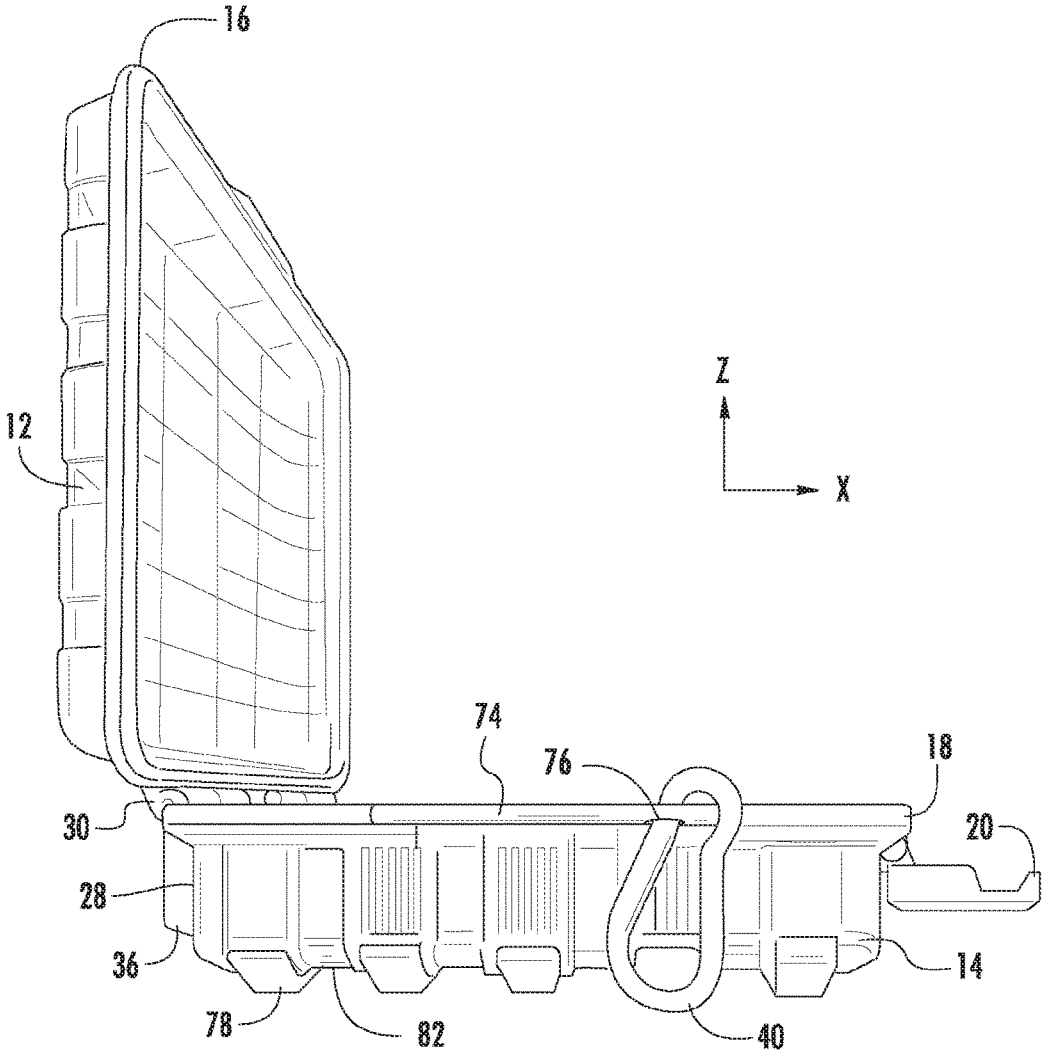
FIG. 7 is a side view of a waterproof container as described herein in an open position.
Figure 8:
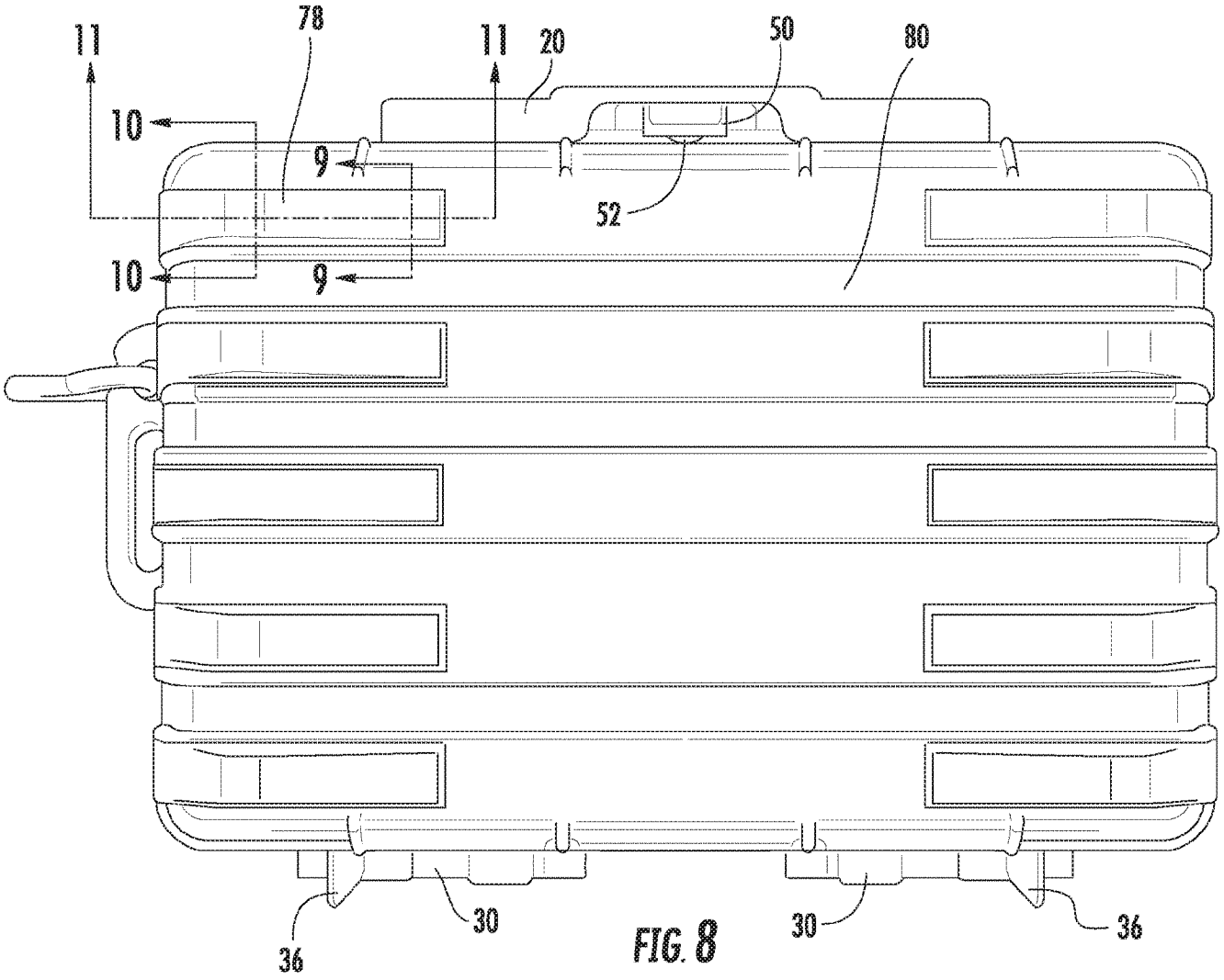
FIG. 8 is a bottom view of a waterproof container as described herein.

In some embodiments, the first and second shells 12, 14 are hingedly coupled at a rear side 28 for rotating the first and second shells 12, 14 between an open position, as shown in FIGS. 6-7, and a closed position, as shown in FIGS. 1 & 3. The first and second shells 12, 14 can be coupled via one or more hinges 30.

In some embodiments, the first and second shells 12, 14 are hingedly coupled by a pair of hinges 30. In such embodiments, the container can include an elongated, traversing element 32 extending between the hinges 30. The elongated, traversing element 32 can be spaced apart from the first and second rims 16, 18 such that a fastening slot 34 is formed between the elongated, traversing element 32 and the first and second rims 16, 18. A user can slide a strap, a rope, or some other fastening device through the fastening slot 34 to secure the waterproof container 10. For example, when whitewater rafting, a user can fasten the waterproof container 10 to the raft by the traversing element 32 so the container 10 is not lost should the raft flip.

In some embodiments, the container 10 can include at least one support projection 36 extending from a rear side 28 of the container 10. The at least one support projection 36 can be adapted for supporting the container on end in a vertical orientation with the latch 20 at the top of the container 10. In some embodiments, one or more support projections 36 can include a support projection orifice 38. The support projection orifice 38 can be adapted to receive the body of a carabineer 40 and the container 10 can include a carabineer 40.

In some embodiments, the support projection 36 can be a fin or a block that extends at least as far as the hinge(s) 30 from the rear side 28 of the container 10. When the support projection 36 is a fin, the support projection 36 can be no more than 0.125 inches wide, or no more than 0.0938 inches wide, or no more than 0.0625 inches wide. Where the support projection 36 is a block, the support projection 36 can be at least 0.25 inches wide, at least 0.5 inches wide, or at least 0.75 inches wide.

Figure 16:
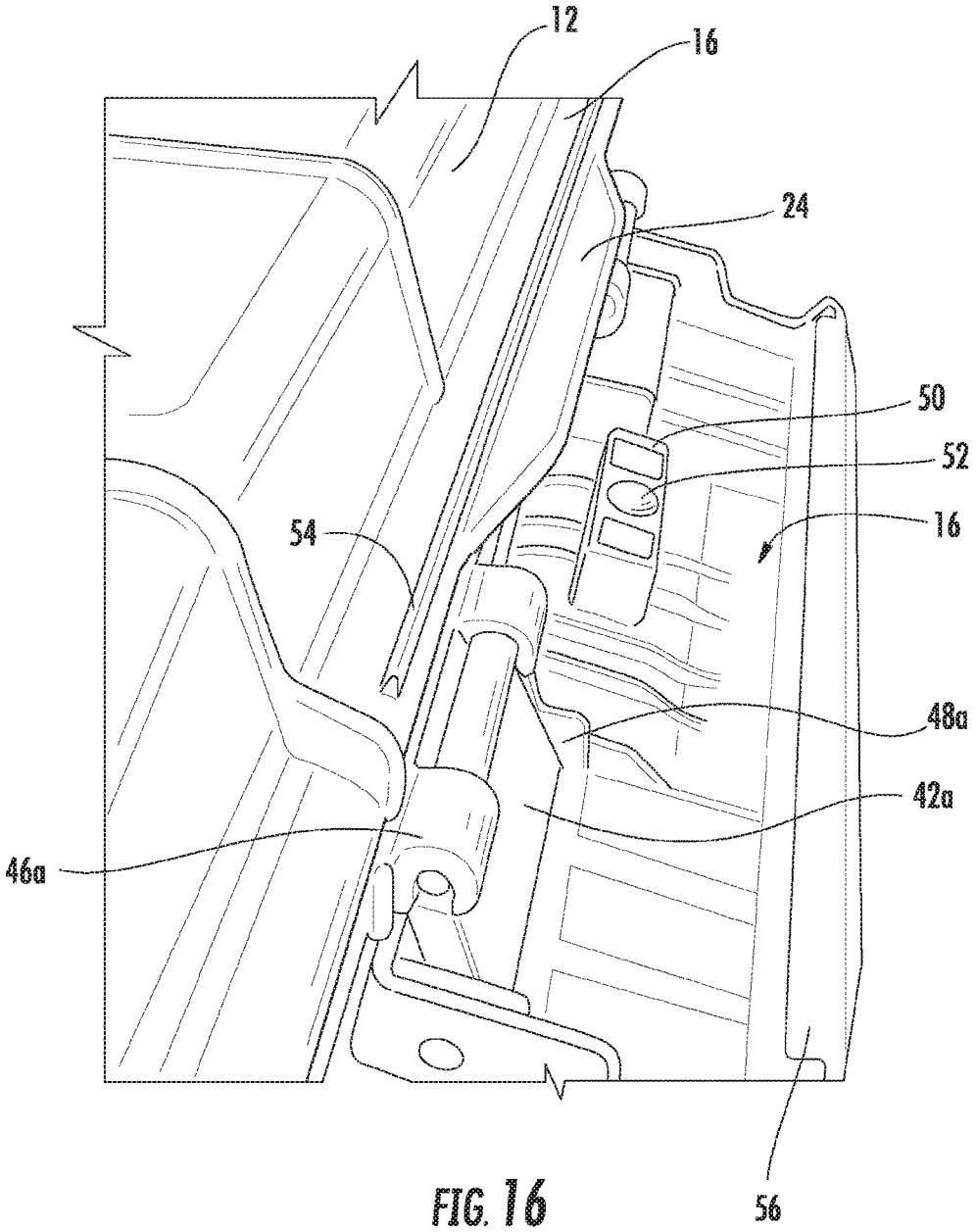
FIG. 16 is a perspective view of the latch mechanism in an open configuration.
Figure 17:
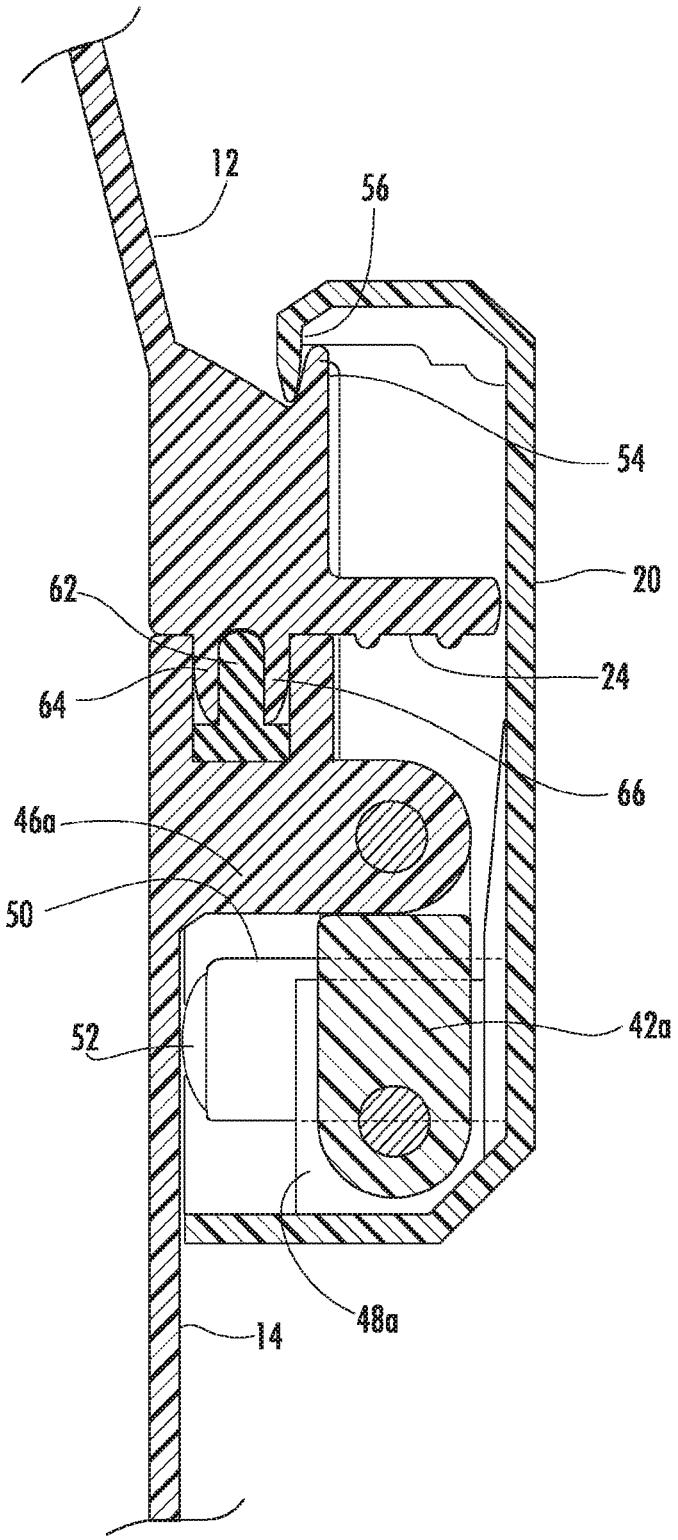
FIG. 17 is a cross-sectional view of the waterproof container of FIG. 1 taken along cut-line 17-17.

As shown in FIGS. 2, 16 and 17, in some embodiments, the latch 20 can include a pivot assembly 42 and a primary assembly 44. The pivot assembly 42 can be rotatably coupled to both the second shell 14 and the primary assembly 44. The primary assembly 44 can be adapted to engage the first rim 16 to lock the container in a closed, mated position. The pivot assembly 42 can include a left pivot assembly **42*a* and a right pivot assembly 42*b*, which are coupled to first and second shell pivot mounts 46*a*, 46*b* of the second shell 14. As shown in FIGS. 2 & 17, the left pivot assembly 42*a*** can be coupled to the first shell pivot mount 46*a* by a hinge, and the right pivot assembly 42*b* can be coupled to the second shell pivot mount 46*b* by a hinge.

In some embodiments, the pivot assembly or assemblies 42, the primary assembly 44, or both 42, 44 can be formed of a rigid material, including, but not limited to, solid (i.e., unfoamed) polystyrene and polycarbonate. In some embodiment, the first shell 12 and the second shell 14 are made of rigid materials, including, but not limited to, polycarbonate and solid polystyrene. The first shell 12, the second shell 14, or both 12, 14 can be transparent or translucent.

In some embodiments, the primary assembly 44 includes left and right latch pivot mounts 48*a*, 48*b* for rotatably coupling to the left and right pivot assembly 42*a*, 42*b*, respectively. The left latch pivot mount 48*a* can be coupled to the left pivot assembly 42*a* by a hinge, and the right latch pivot mount 48*b* can be coupled to the right pivot 42*b* assembly by a hinge. In some embodiments, the latch recess 26 is adapted to receive the pivot assembly or assemblies 42 when the latch 20 is locked to secure the first shell 12 to the second shell 14 in the mated position. As shown in FIGS. 1 & 2, the latch recess 26 can completely cover the pivot assembly or assemblies 42 from the front when the latch is in the locked position.

In some embodiments, the primary assembly 44 can include a support leg 50 adapted to rest against an outside surface of the second shell 14 when the latch 20 secures the first shell 12 to the second shell 14 in the mated position. In some embodiments, the support leg 50 includes a cushion 52 at a distal end of the support leg 50 for cushioning the impact of the support leg 50 against the outside of the second shell 14 when the latch 20 snaps closed. The cushion 52 can be made of a resilient, elastomeric material, including, but not limited to, natural rubber and synthetic rubber, including, but not limited to, styrene-butadiene-rubber (SBR).

In some embodiments, the first rim 12 comprises an elongated retention ridge 54 extending upwardly, laterally along a front portion of the first rim 12, and an upper portion of the primary assembly 44 comprises a laterally- and downwardly-extending, clamping ridge 56. The container 10 can be adapted so that the clamping ridge 56 extends over the retention ridge 54 to lock the first shell 12 to the second shell 14 when the latch 20 is in a locked position as shown in FIG. 1. In some embodiments, the retention ridge 54 and the clamping ridge 56 are both linear ridges. In some embodiments, a distal end of the clamping ridge 56 is forward of or even with a proximal end of the clamping ridge 56 when the latch 20 is in the locked position.

In some embodiments, the second rim 18 comprises a continuous recess 58 that includes a seal ridge 62 between, but spaced apart from, a pair of continuous sides 60. In some embodiments, the first rim 16 comprises inner and outer continuous sealing ridges 64, 66. In the mated position, the sealing ridges 64, 66 are between the continuous sides 60 and on opposite sides of the seal ridge 62.

Figure 5:
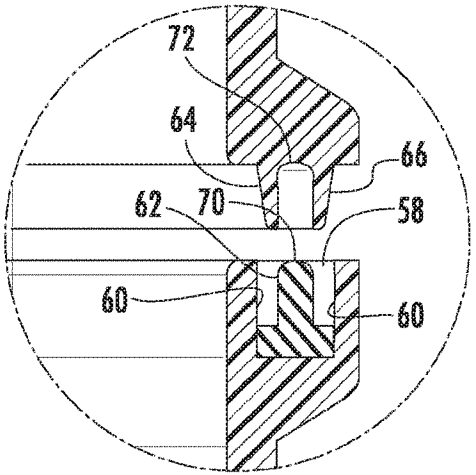
FIG. 5 is a close-up view of the interlocking rim features of the first and second rims shown in FIG. 4.

As shown in FIGS. 4-5, the seal ridge 62 can be part of a seal 68 that extends along a bottom of the continuous recess 58. The sealing ridge 62, seal 68, or both can be formed of a resilient material. Examples of resilient materials include, but are not limited to, rubbers, such as natural rubber and SBR, and elastomers. The sealing ridges 64, 66 and the sides 60 can be formed of a rigid material. For example, the sealing ridges 64, 66 and the sides 60 can be formed of the same material as the rest of the first shell 12 and the second shell 14, respectively.

In such embodiments, the rigid sealing ridges 64, 66 can press into the seal 68 (i.e., there is an interference fit) to facilitate an airtight and liquid tight seal when the first and second shell 12, 14 are locked in the mated position with the latch 20 locked. Similarly, the airtight and liquid tight seal can be facilitated where the seal ridge 62 is wider than the distance between the inner and outer sealing ridges 64, 66, and or a peak 70 of the seal ridge 62 is depressed in the valley 72 between the inner and outer sealing ridges 64, 66 when the first and second shell 12, 14 are in the mated position with the latch 20 locked. The sealing ridges 64, 66 can have a generally triangular cross-section, the seal ridge 62 can have a generally triangular cross-section, all of the ridges 62, 64, 66 can have a generally triangular cross-section. As shown in FIG. 5, the seal ridge 62 can have a generally U-shaped cross-section.

Although the first rim 16 is described as having the inner and outer sealing ridges 64, 66 and the second rim 18 is described as including the continuous recess 58, seal ridge 62, and seal 68, it should be understood that this arrangement can be reversed.

In some embodiments, the container 10 includes a fastening projection 74 extending laterally from a side of the container 10. The fastening projection 74 can include a fastening projection orifice 76. The fastening projection orifice 76 can be adapted for receiving the body of a carabineer 40. The container 10 can also include a carabineer 40 attached to the fastening projection orifice 76. In some embodiments, the container 10 can include a first fastening projection 74*a* with a first fastening projection orifice 76*a* extending from the first shell 12 and a second fastening projection 74*b* with a second fastening projection orifice 76*b* extending from the second shell 14, where the first and second fastening projection orifices 76*a*, 76*b* align so that a carabineer can pass through the orifices 76*a*, 76*b* and prevent the container from opening more than a controlled amount (i.e., more than the length of the carabineer).

In some embodiments, the first shell 12, the second shell 14, or both 12, 14 can include a plurality of feet 78 coupled to a base surface 80 of the first shell 12, a base surface 82 of the second shell 14, or both. In some embodiments, the base surface(s) 80, 82 can include one or more channels 84 and a foot 78 an slide into each channel 84. In some embodiments, the foot 78 and the channel 84 can be designed so that the foot 78 cannot be removed from the channel 84 once it is inserted in the channel 84. In some embodiments, the foot 78 can slide into the channel 84.

Figure 9:
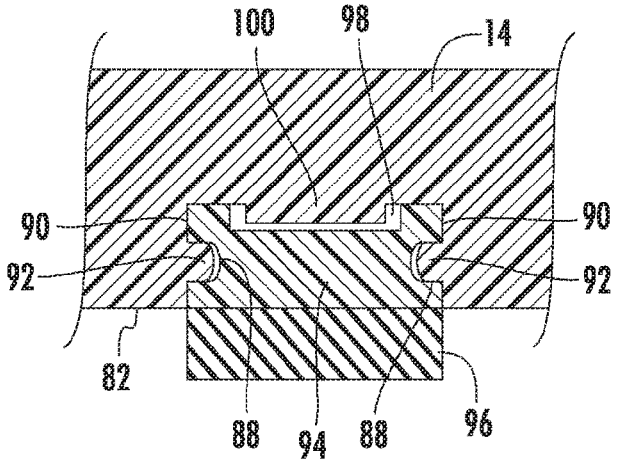
FIG. 9 is a cross-sectional view of the waterproof container of FIG. 8 taken along cut-line 9-9.
Figure 10:
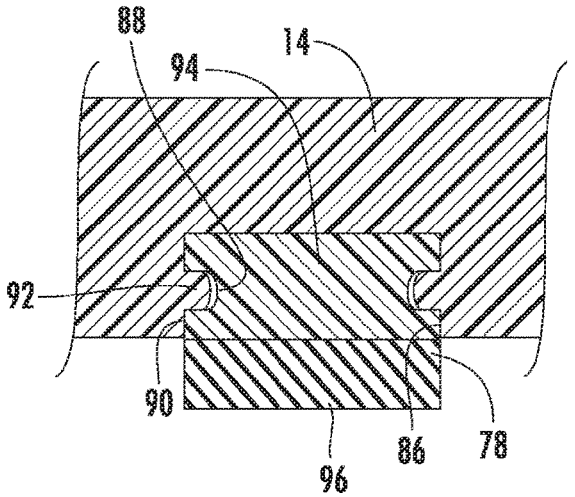
FIG. 10 is a cross-sectional view of the waterproof container of FIG. 8 taken along cut-line 10-10.
Figure 11:
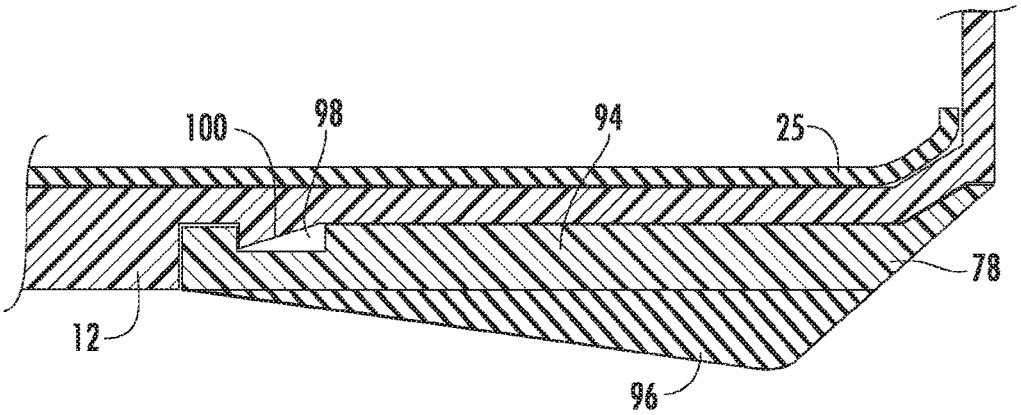
FIG. 11 is a cross-sectional view of the waterproof container of FIG. 8 taken along cut-line 11-11.

In some embodiments, the foot 78 can slide into the channel 84 as part of a tongue and groove configuration. For example, as shown in FIGS. 9-11, each long-edge 86 of each foot 78 can include a groove 88 and each laterally-extending side 90 of each channel 84 can include a tongue 92. Although not shown, this arrangement can be reversed such that each long-edge 86 of each foot 78 can include a tongue and each laterally-extending side 90 of each channel 84 can include a groove.

The foot 78 and channel 84 can be adapted to prevent the foot 78 from sliding out of the channel 84 once it is inserted. In some embodiments, the foot 78 can include a retention recess 98 on a surface facing the shell 12, 14 and the channel 84 can include a retention projection 100 that extends into the retention recess 98 when they 98, 100 are aligned. As shown in FIG. 11, the retention recess 98 can have vertical sides and a vertical portion of the retention projection 100 can contact a vertical side of the retention recess 98 to prevent the foot 78 from sliding out of the channel 84 once it is inserted. The retention recess 98 can have a square or rectangular cross-section. The retention projection can have a ramp shaped cross-section, as shown in FIG. 11.

In some embodiments, the foot 78 can include a foundation 94 and a leveling support 96, which projects down from the container 10 when the foot 78 is mounted in the channel 84. The foundation 94 can be made of a rigid material in order to retain the foot 78 in the channel 84 for the lifetime of the container 10. The leveling support 96 can be formed from a resilient material and can have a generally, triangular shape, as shown in FIG. 11. Rigid and resilient materials useful for the foundation 94 and leveling support 96 include, but are not limited to, those rigid and resilient materials listed elsewhere herein.

As best shown in FIGS. 12-15 and 18-50, the container 10 can also include a variety of dividers 180 that can be removably mounted to the walls 176, 177, 178, 179 of a shell 12, 14 and/or removably mounted to each other 180. The dividers 180 can be removably mounted within the container 10 to form various compartments within the storage volume 22. In some embodiments, the one or more dividers 180 can be removably mounted to opposing walls, e.g., opposing side walls 176, 177 or opposing lateral walls 178, 179. In some embodiments, the one or more dividers 180 can be removably mounted to another divider 180. In other embodiments, the one or more dividers 180 can be removably mounted to a wall 176-179 and another divider 180. Each removable divider 180 can also include engaging portions 183 for engagement with a wall 176-179 or with corresponding coupling members 186 on the walls 176-179 or other dividers 180.

Engaging portions 183 can include any suitable structure for removably mounting the divider 180, including, without limitation, flared edges, other projections, grooves, tracks, non-slip materials, and/or combinations thereof. The engaging portions 183 of a divider 180 can be received by or otherwise removably engage with coupling members 186, adapted to receive the engaging portion 183. For example, coupling members 186 can includes tracks, grooves, projections, flared edges, surfaces for engaging non-slip materials, and/or combinations thereof.

A top edge of the removable divider 180 can also include a flared stabilizing portion 185. The flared stabilizing portion 185 can provide additional stability to the divider 180 and/or facilitate gripping of the divider 180 during insertion or removal from the container.

Figure 13:
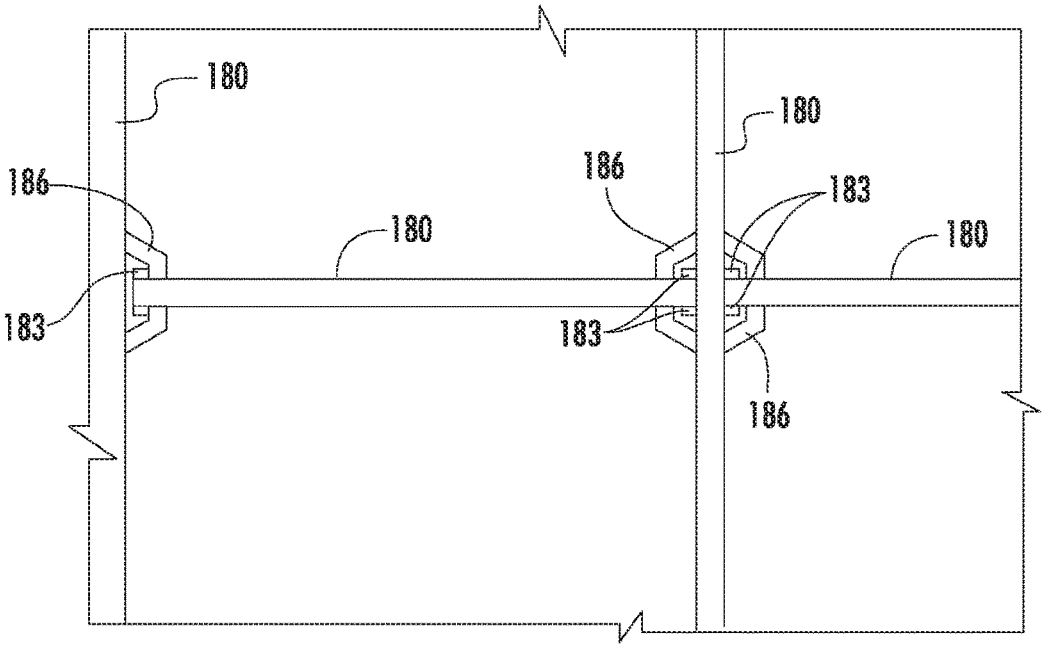
FIG. 13 is a top view of dividers as described herein.
Figure 15:
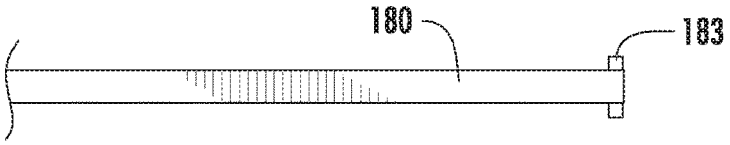
FIG. 15 is a top view of a divider with a flared edge as described herein.
Figure 18:
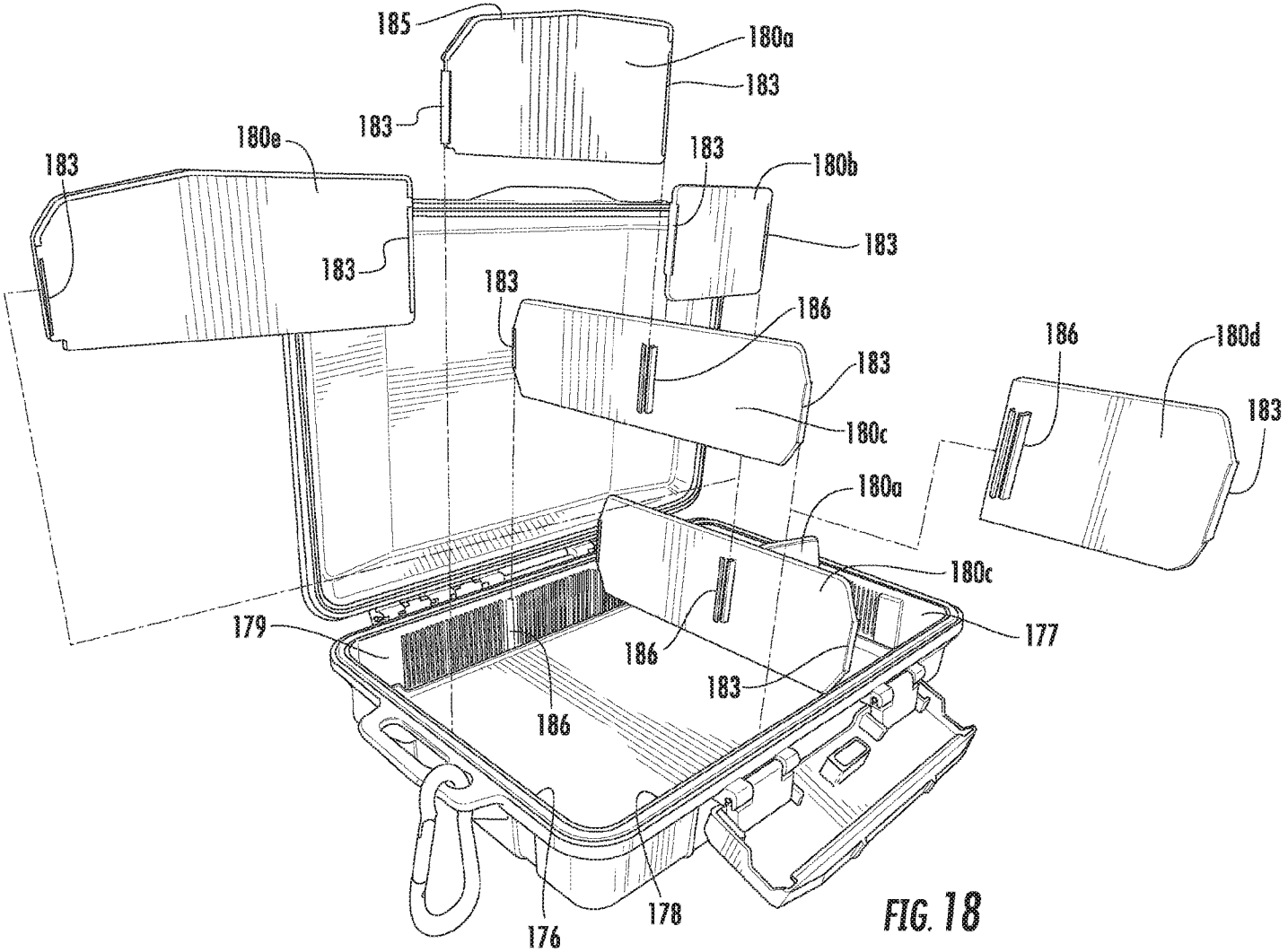
FIG. 18 is an exploded, perspective view a waterproof container in the open position and dividers as described herein.
Figure 19:
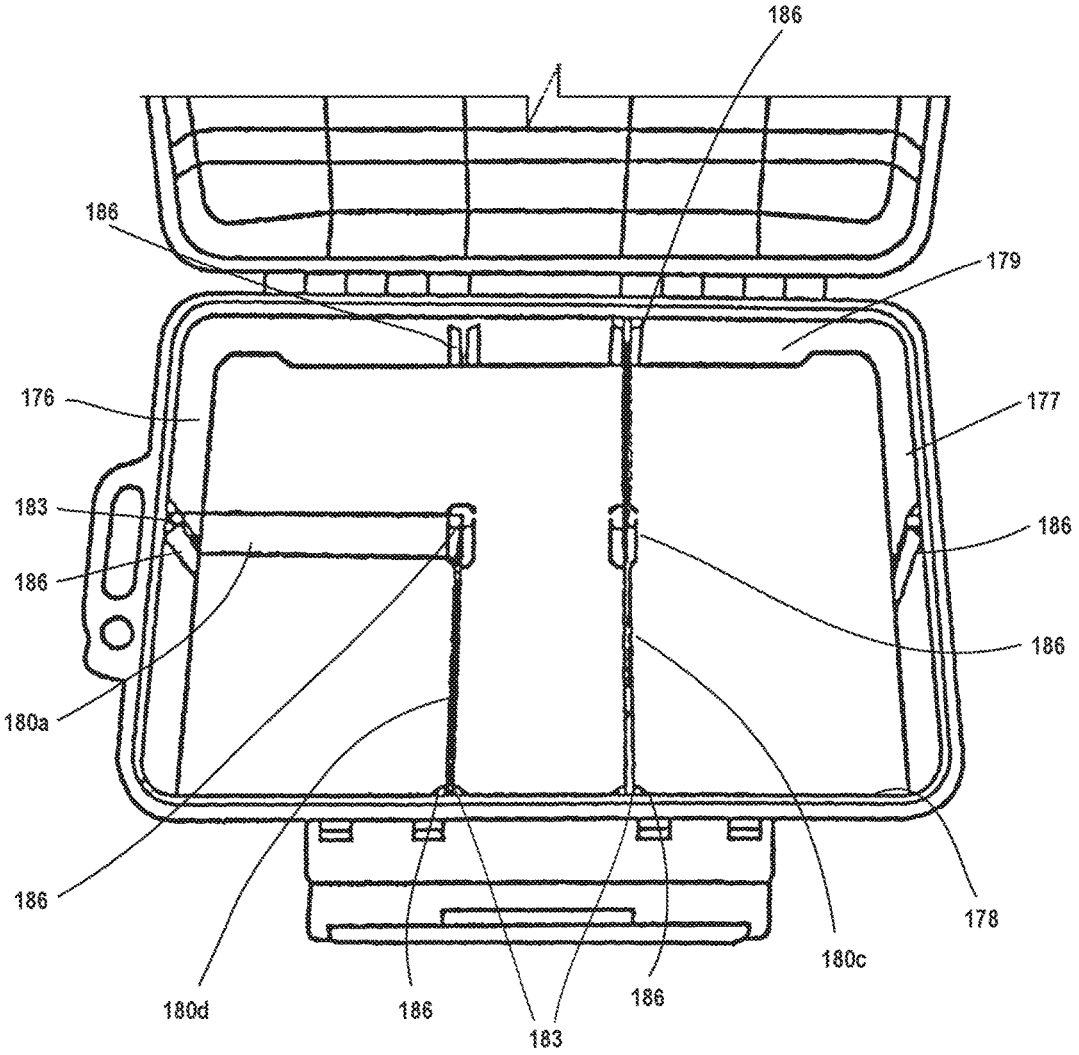
FIG. 19 is a top view a waterproof container in the open position with dividers in an arrangement as described herein.
Figure 20:
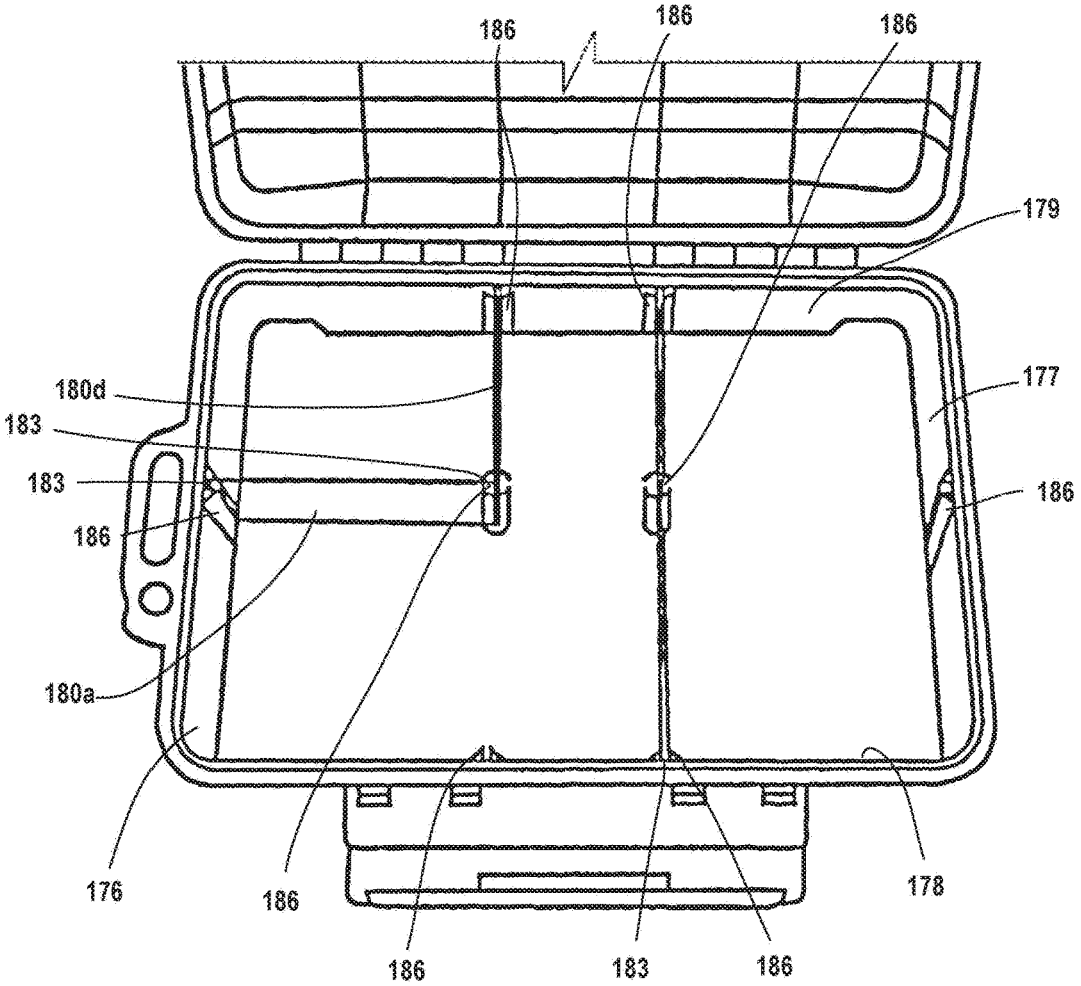
FIG. 20 is a top view a waterproof container in the open position with dividers in an arrangement as described herein.
Figure 21:
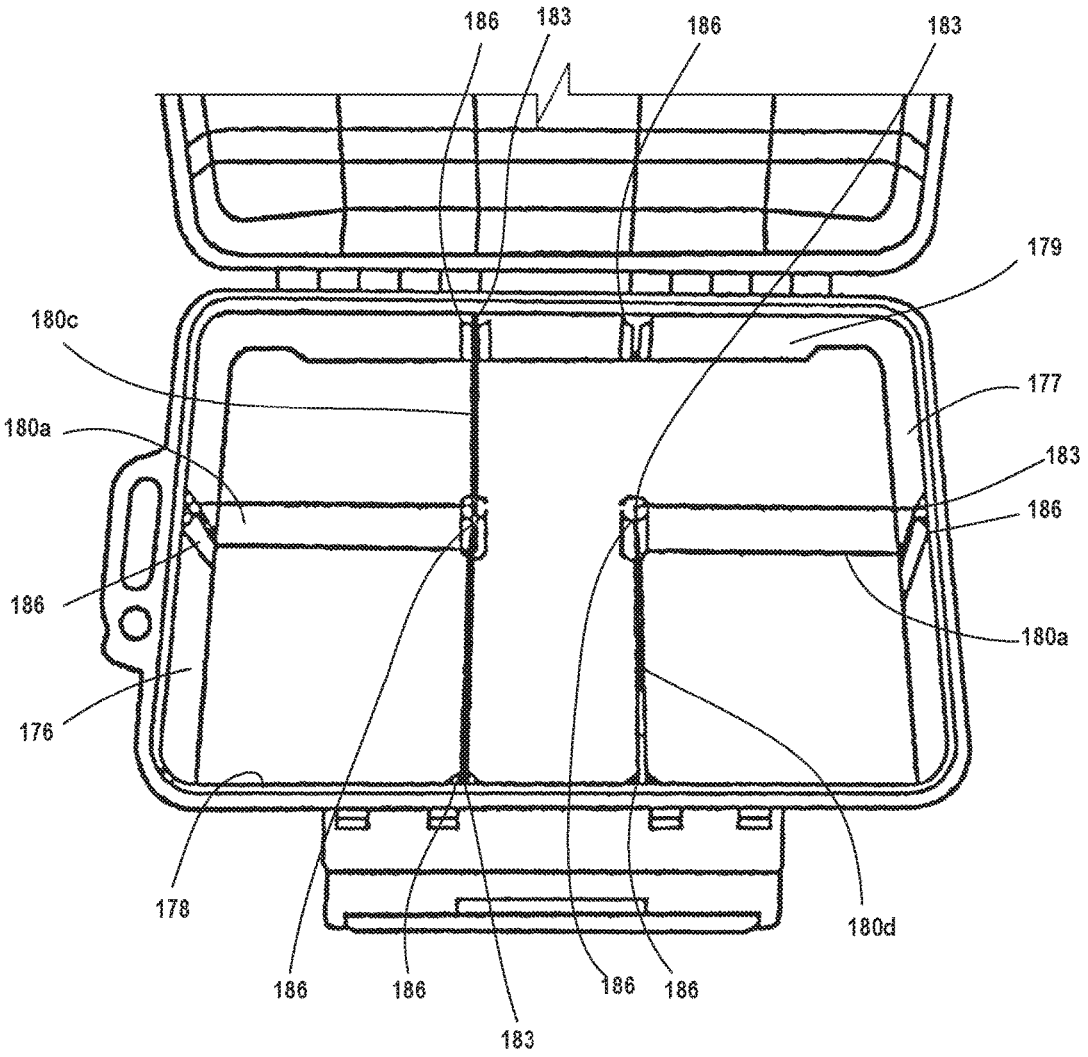
FIG. 21 is a top view a waterproof container in the open position with dividers in an arrangement as described herein.
Figure 22:
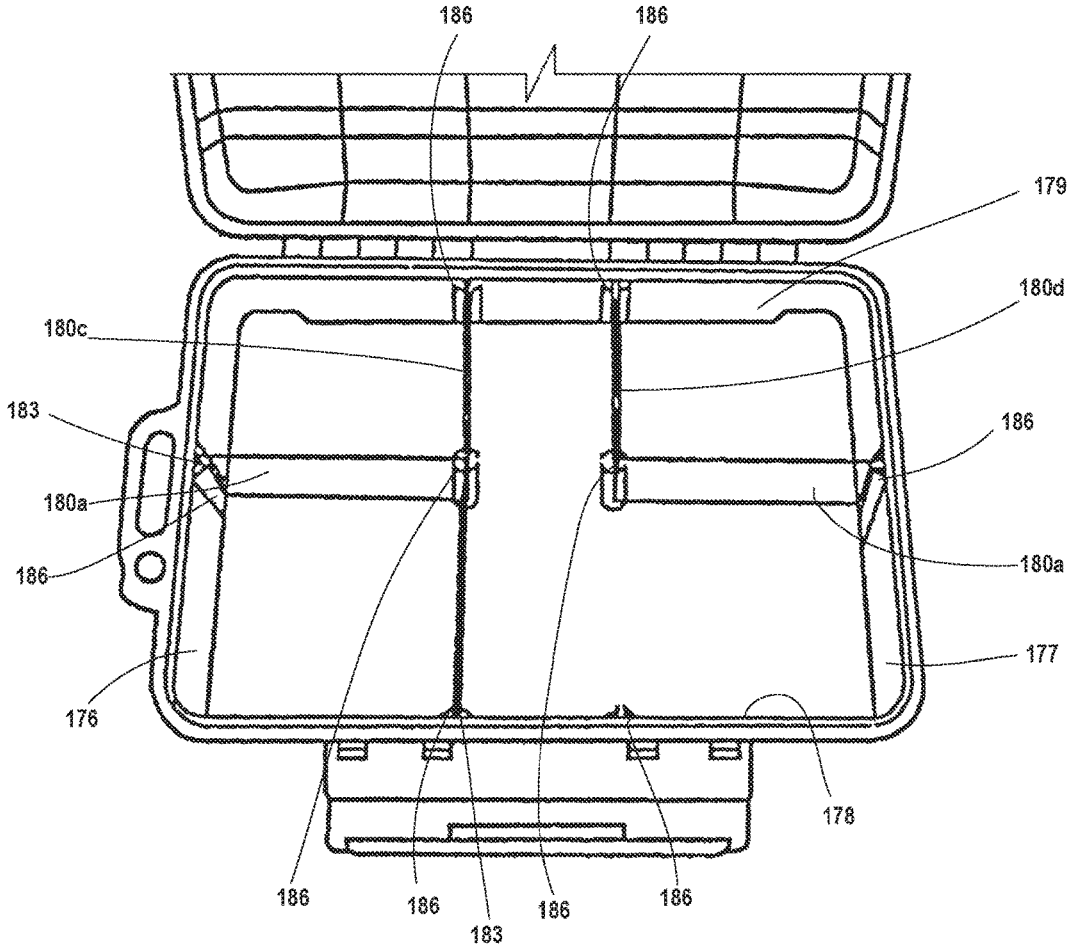
FIG. 22 is a top view a waterproof container in the open position with dividers in an arrangement as described herein.
Figure 23:
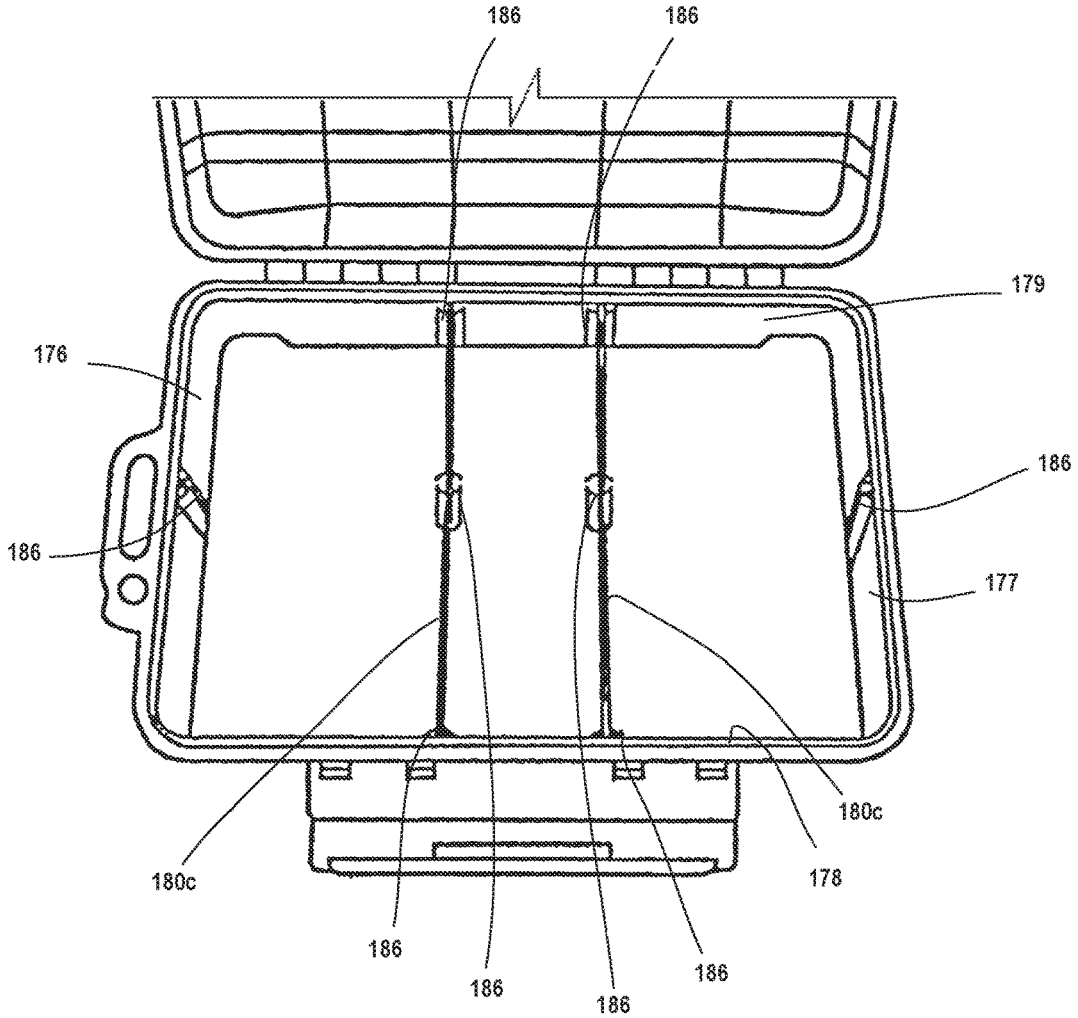
FIG. 23 is a top view a waterproof container in the open position with dividers in an arrangement as described herein.
Figure 24:
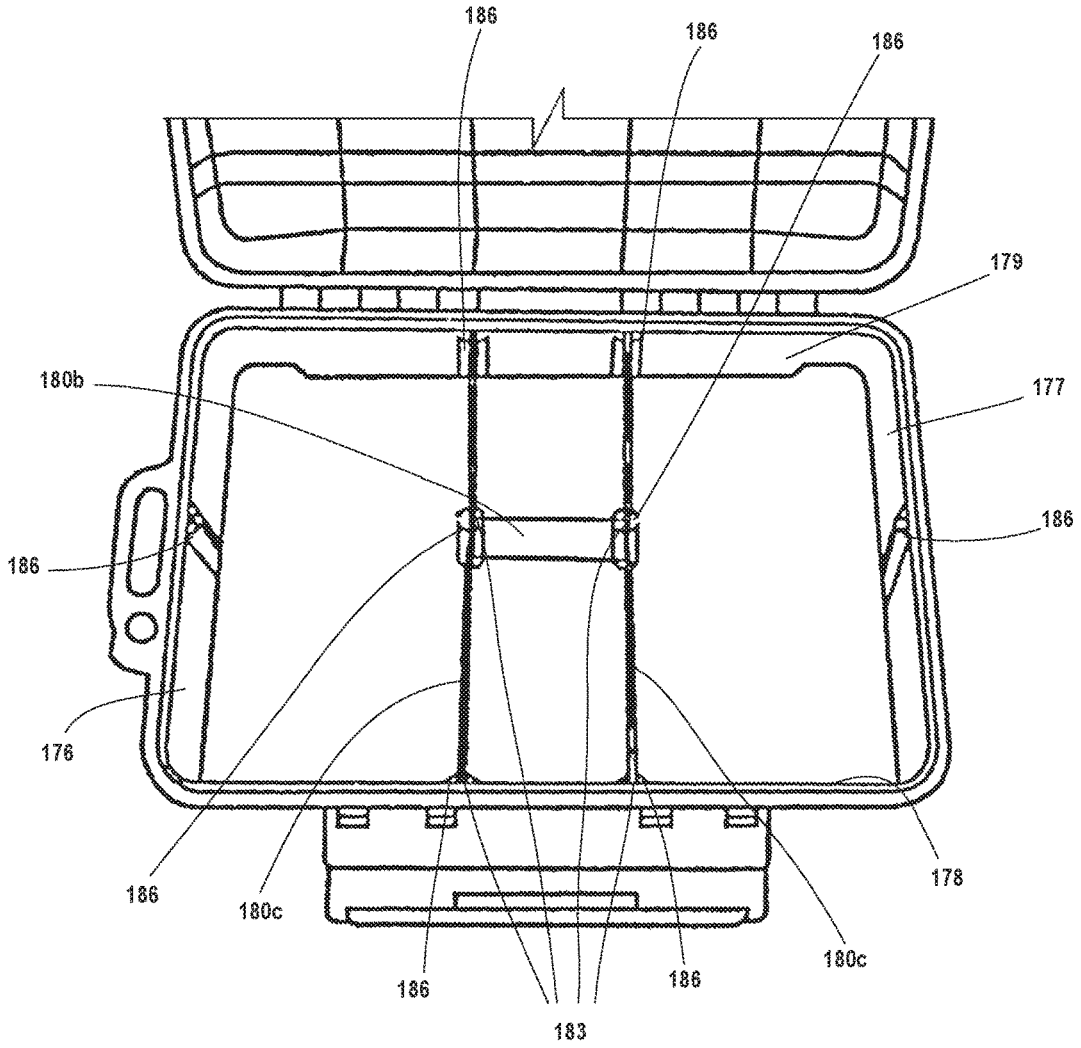
FIG. 24 is a top view a waterproof container in the open position with dividers in an arrangement as described herein.
Figure 25:
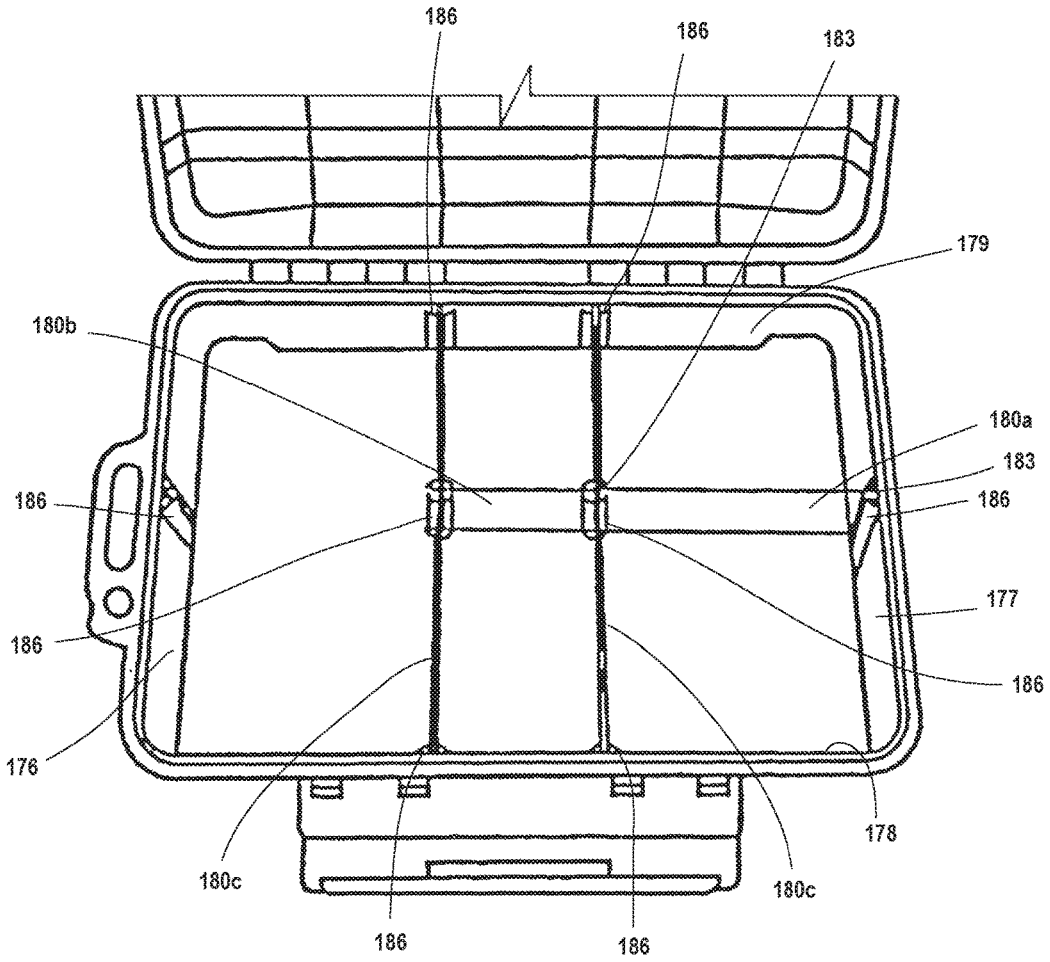
FIG. 25 is a top view a waterproof container in the open position with dividers in an arrangement as described herein.
Figure 26:
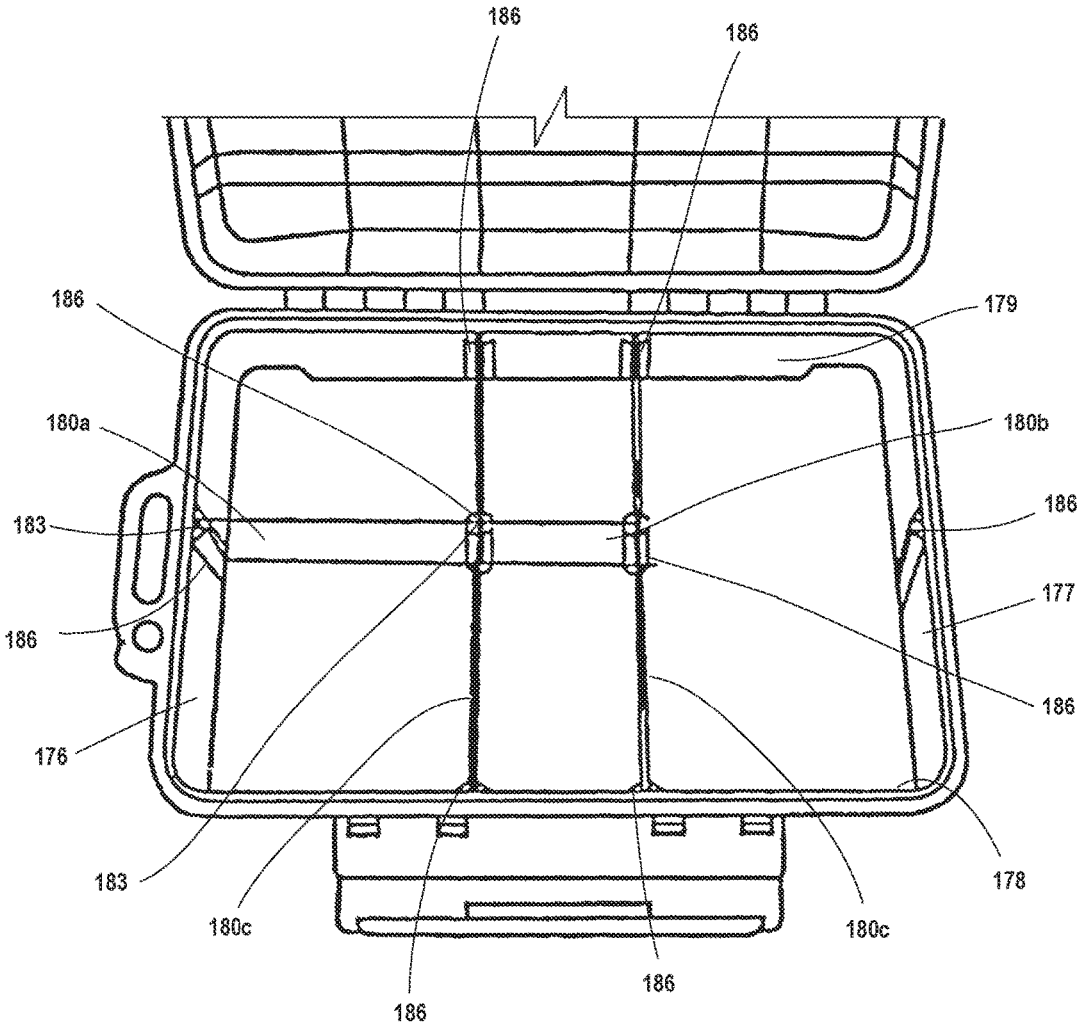
FIG. 26 is a top view a waterproof container in the open position with dividers in an arrangement as described herein.
Figure 27:
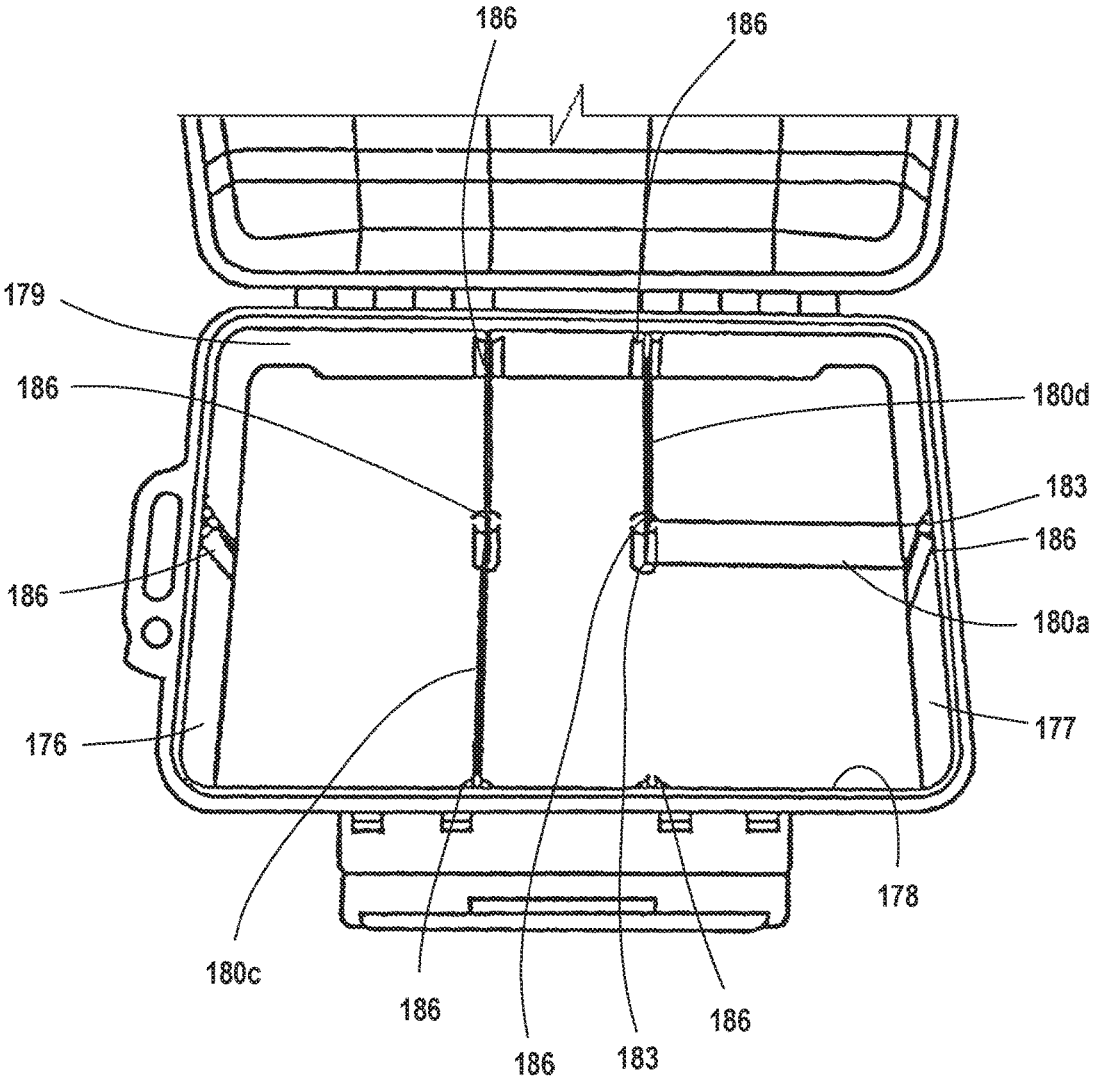
FIG. 27 is a top view a waterproof container in the open position with dividers in an arrangement as described herein.
Figure 28:
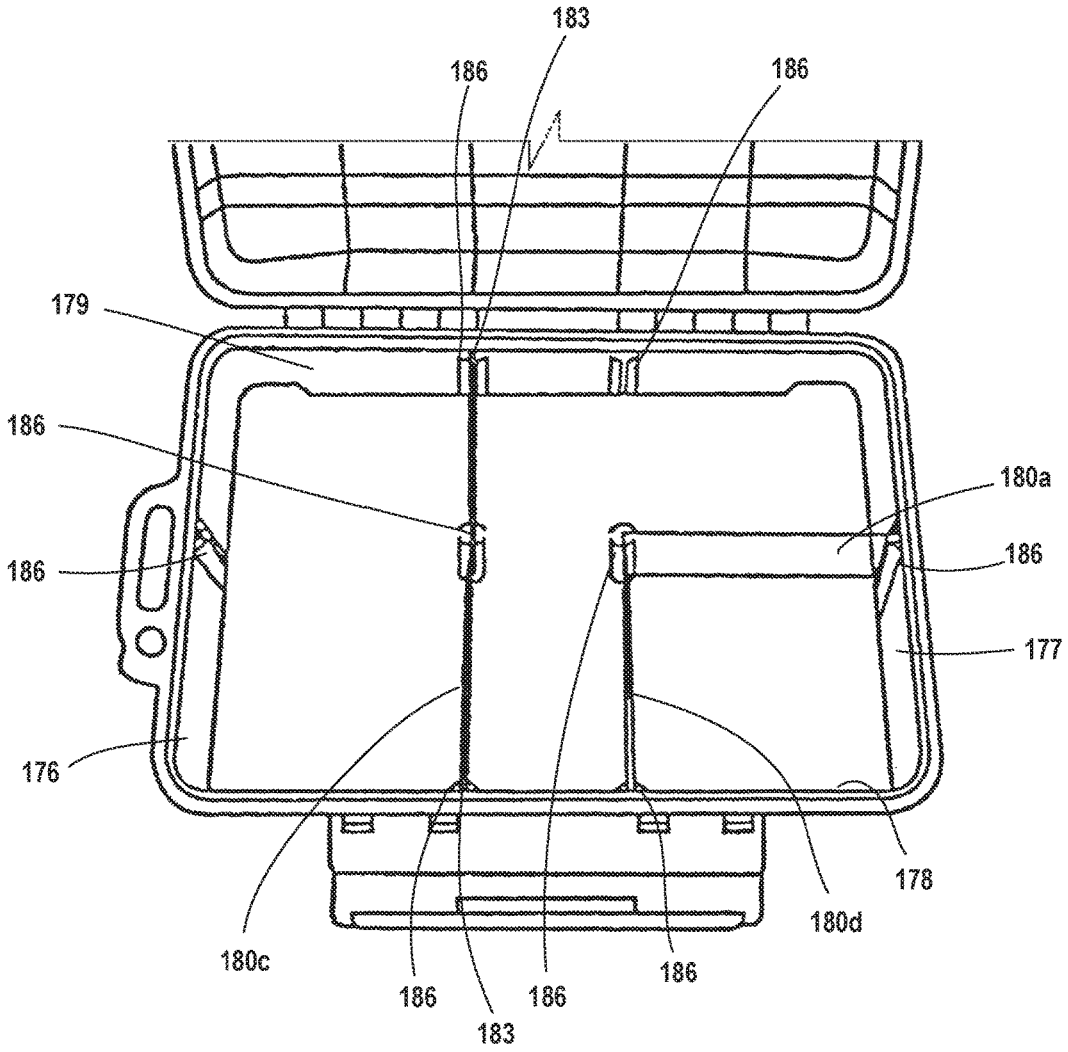
FIG. 28 is a top view a waterproof container in the open position with dividers in an arrangement as described herein.
Figure 29:
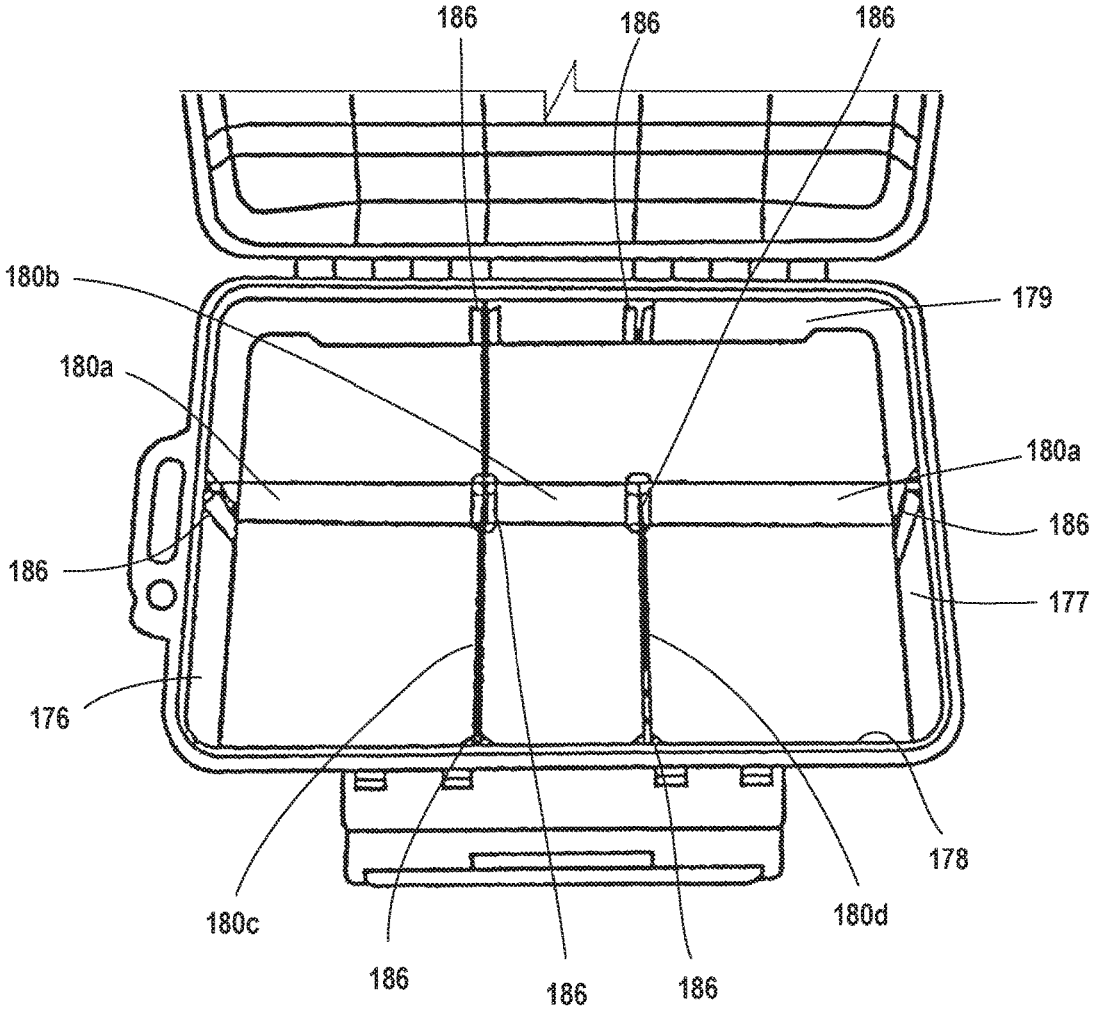
FIG. 29 is a top view a waterproof container in the open position with dividers in an arrangement as described herein.
Figure 30:
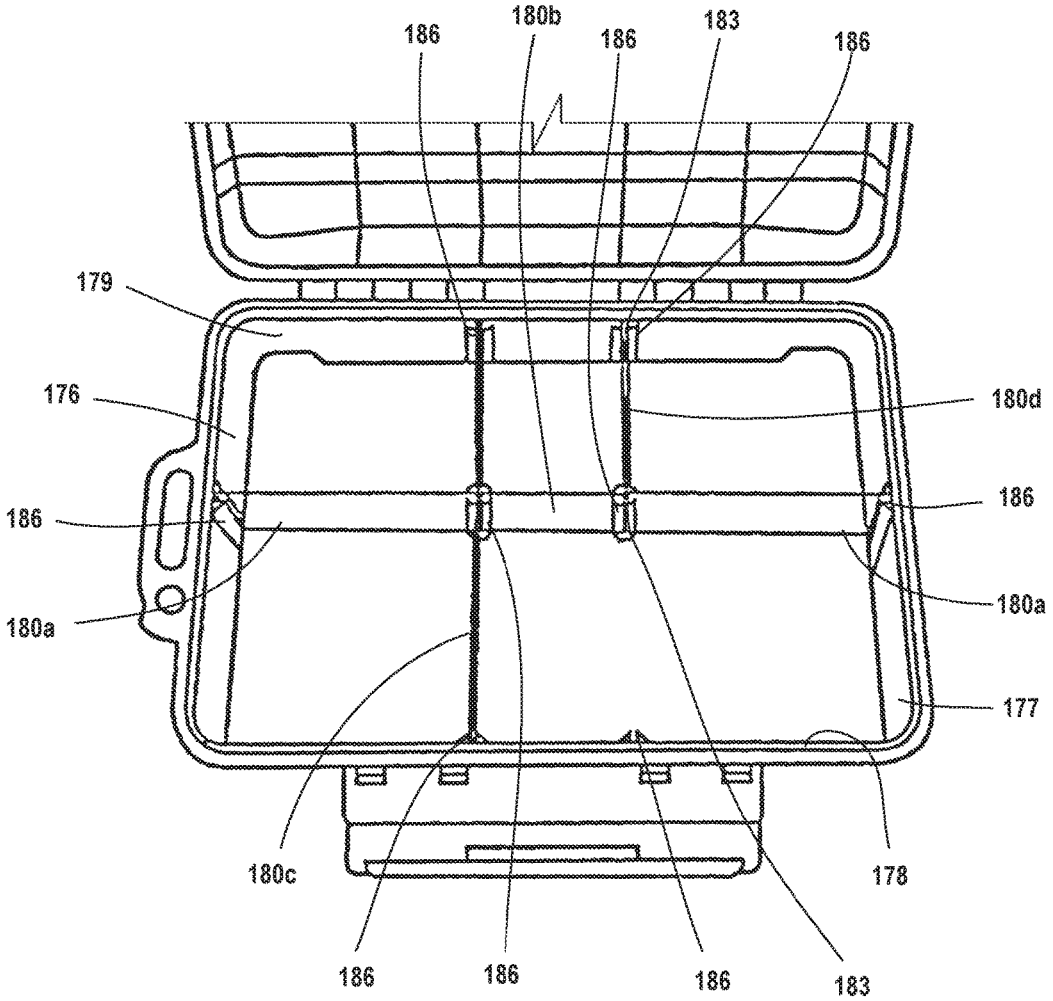
FIG. 30 is a top view a waterproof container in the open position with dividers in an arrangement as described herein.
Figure 31:
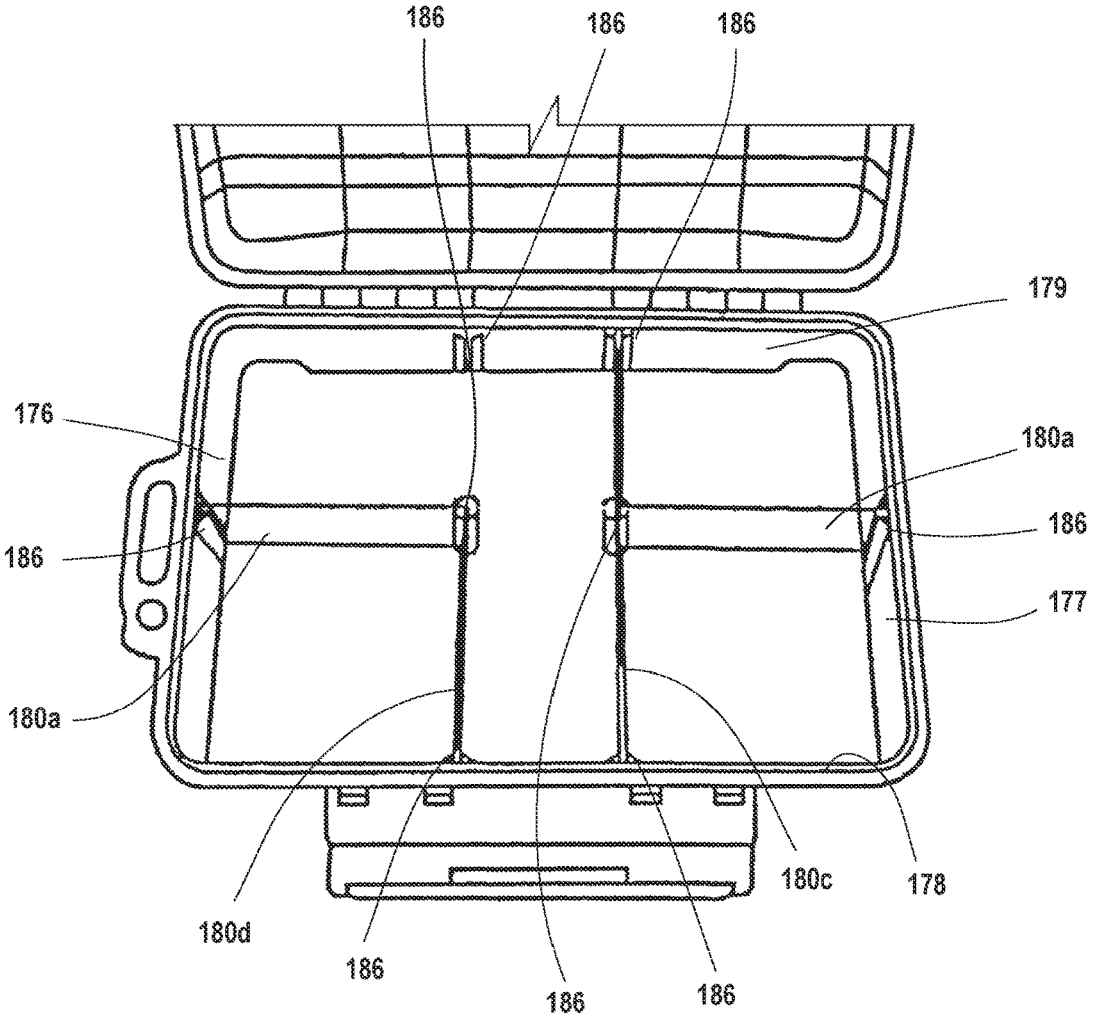
FIG. 31 is a top view a waterproof container in the open position with dividers in an arrangement as described herein.
Figure 32:
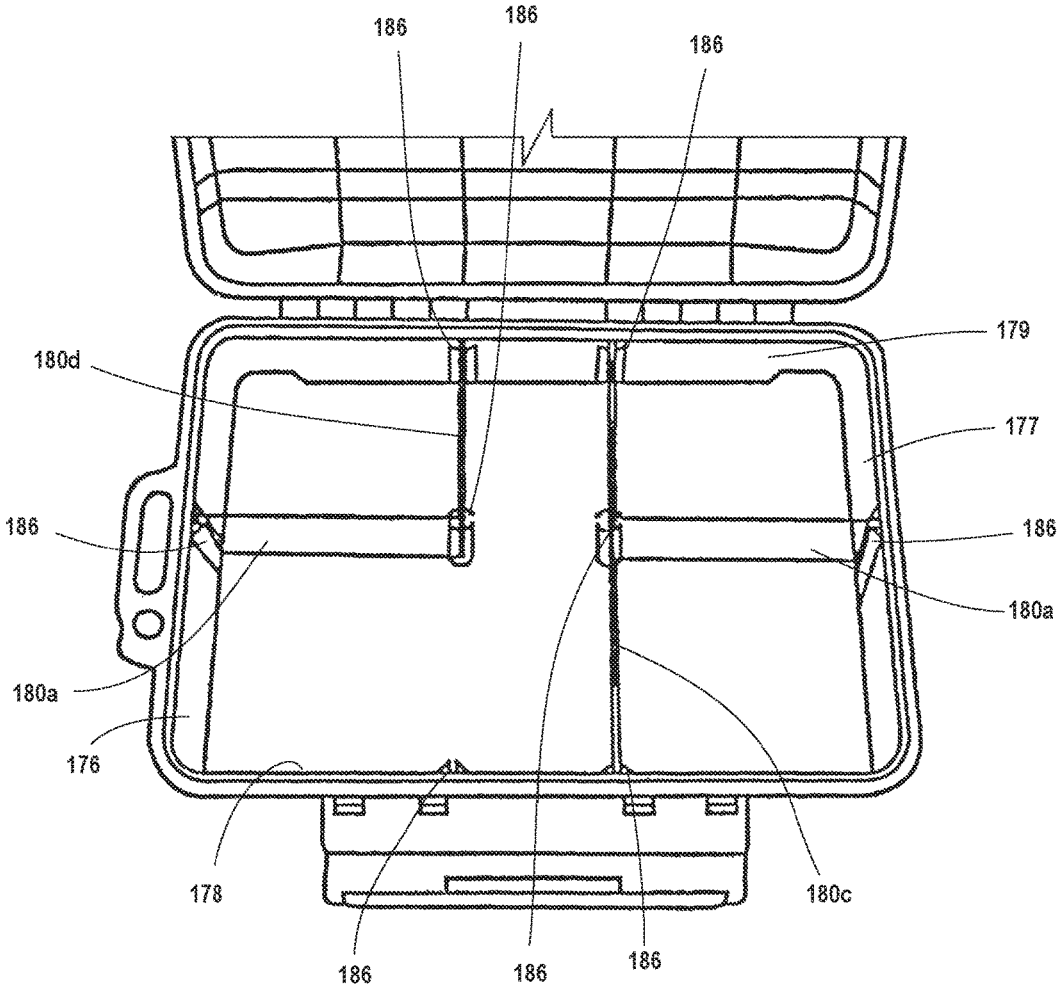
FIG. 32 is a top view a waterproof container in the open position with dividers in an arrangement as described herein.
Figure 33:
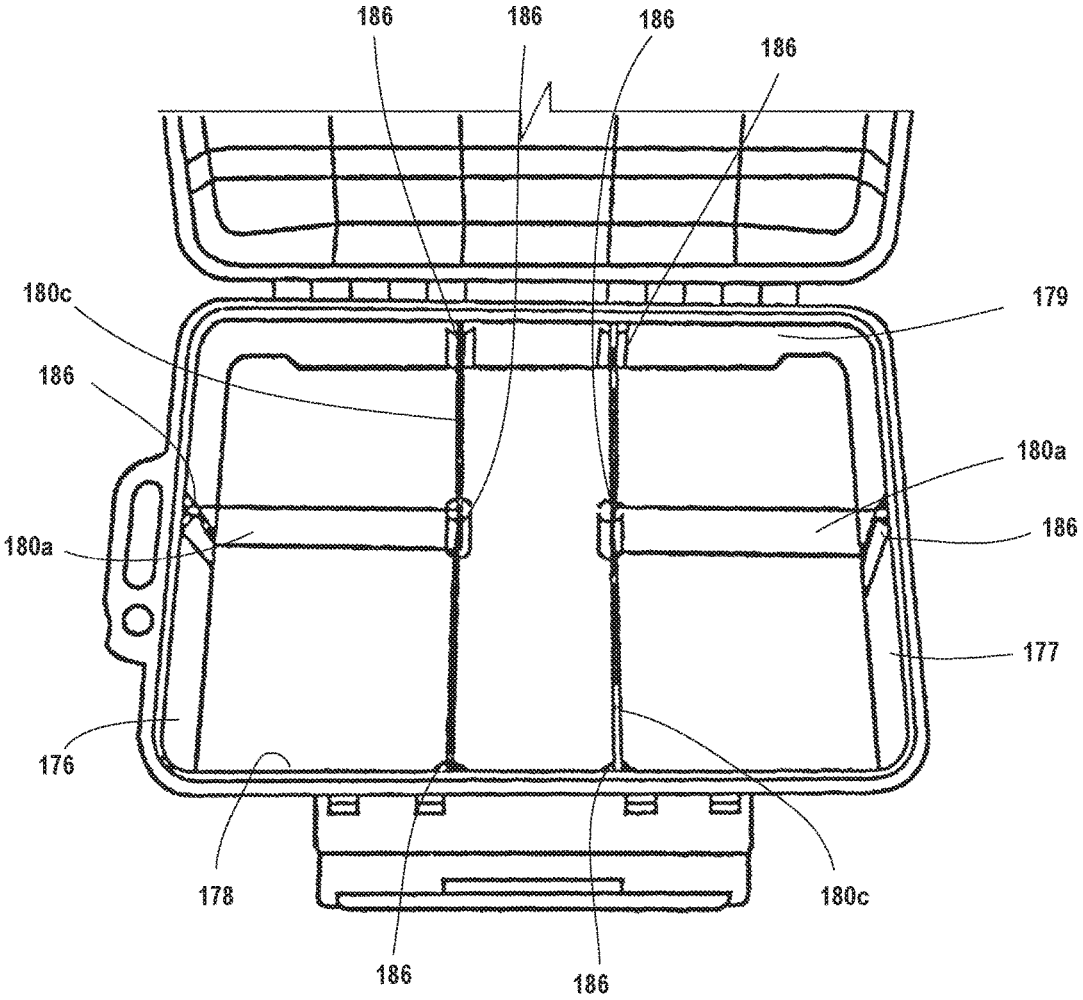
FIG. 33 is a top view a waterproof container in the open position with dividers in an arrangement as described herein.
Figure 34:
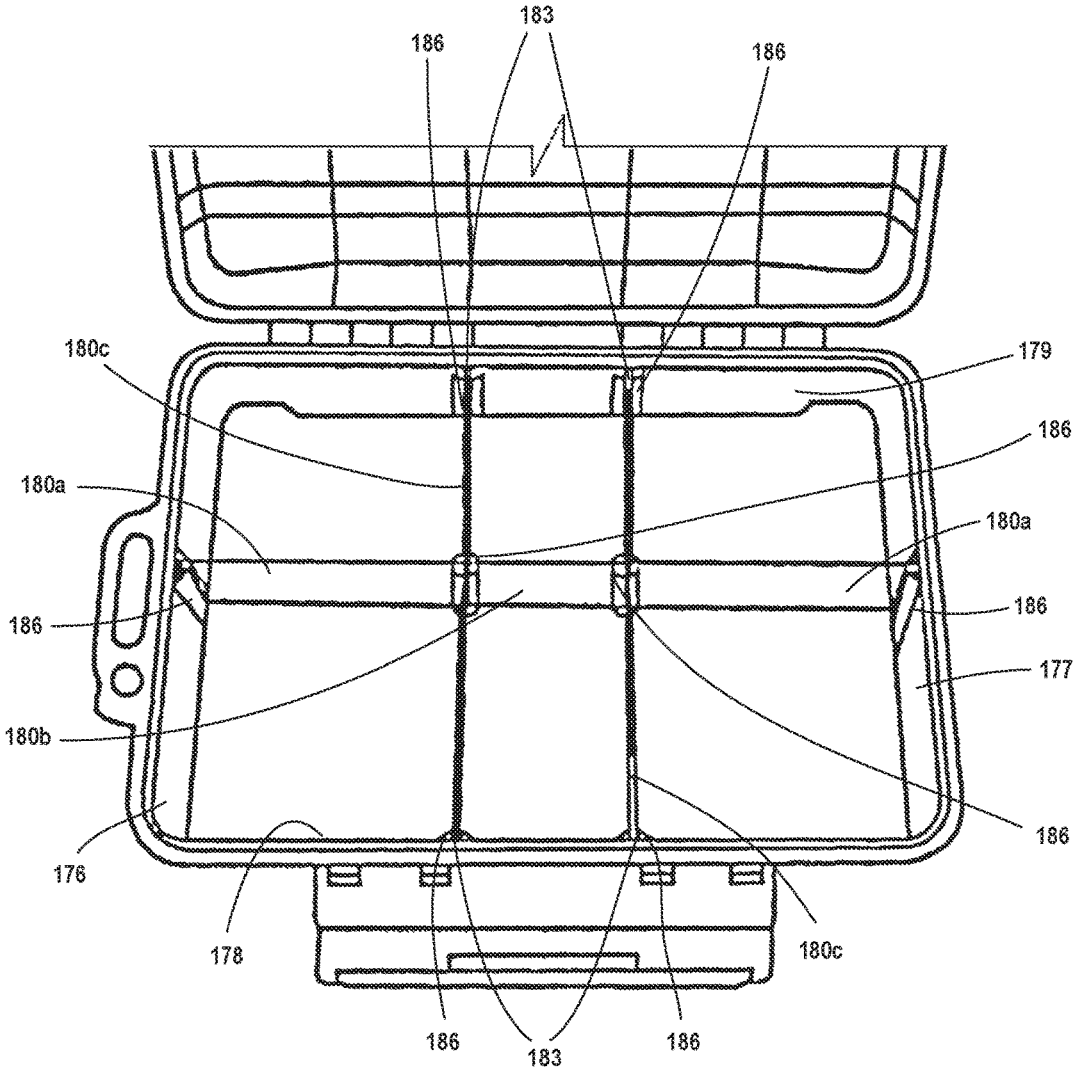
FIG. 34 is a top view a waterproof container in the open position with dividers in an arrangement as described herein.
Figure 35:
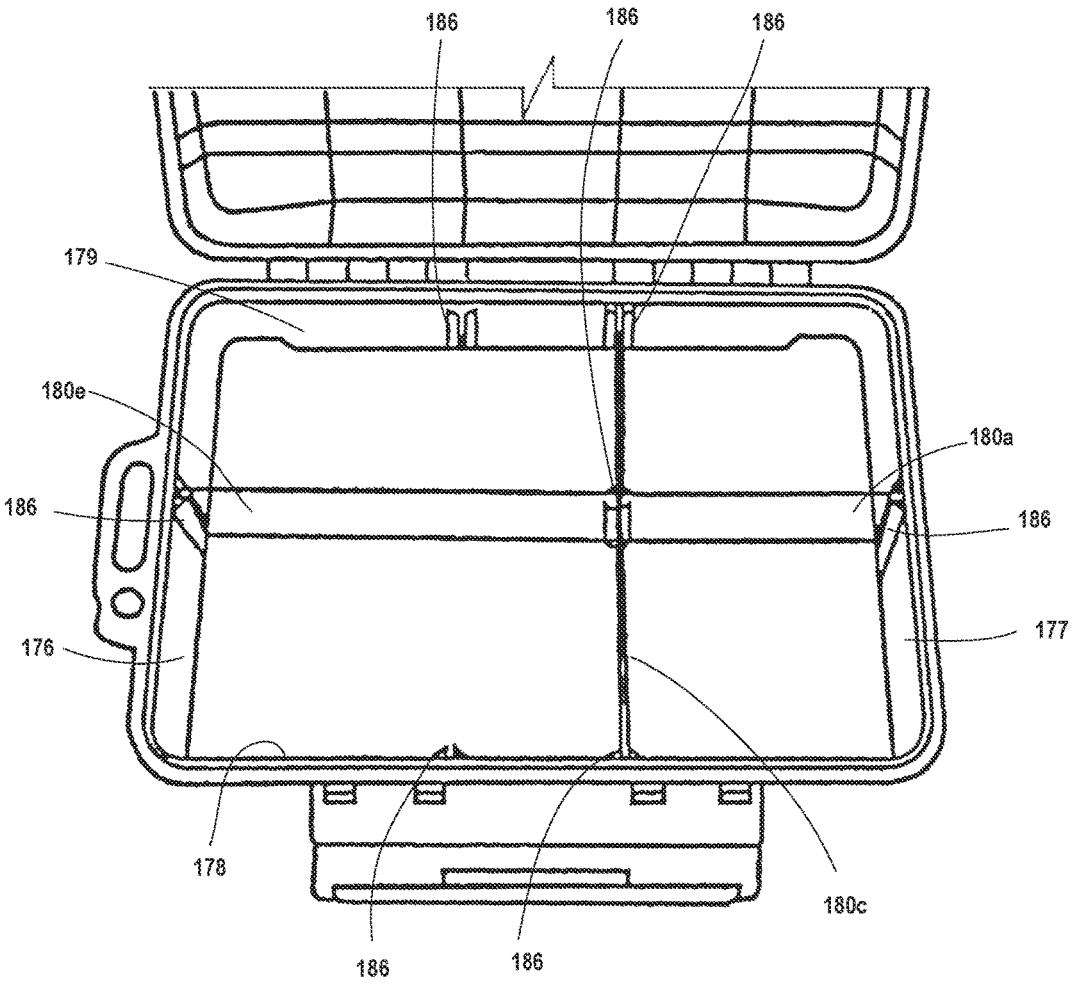
FIG. 35 is a top view a waterproof container in the open position with dividers in an arrangement as described herein.
Figure 36:
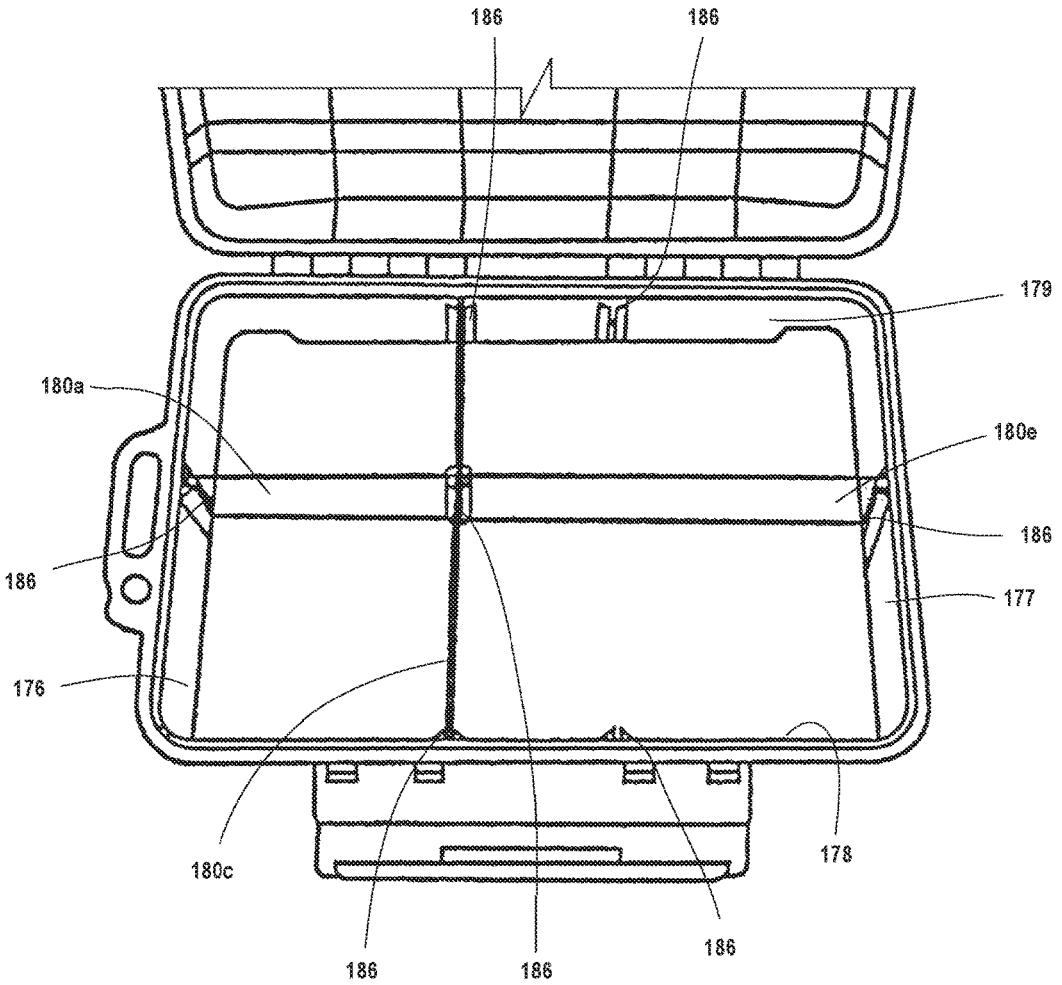
FIG. 36 is a top view a waterproof container in the open position with dividers in an arrangement as described herein.
Figure 37:
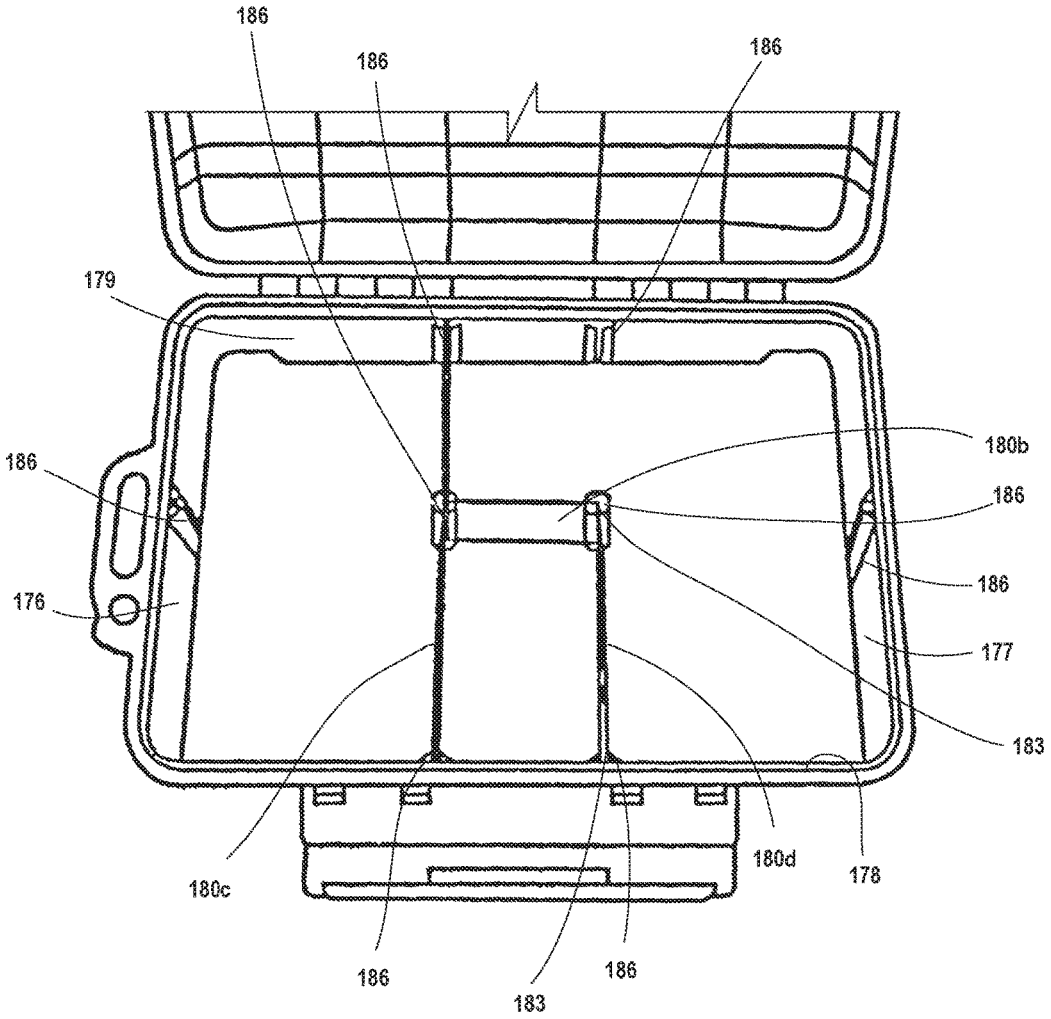
FIG. 37 is a top view a waterproof container in the open position with dividers in an arrangement as described herein.
Figure 38:
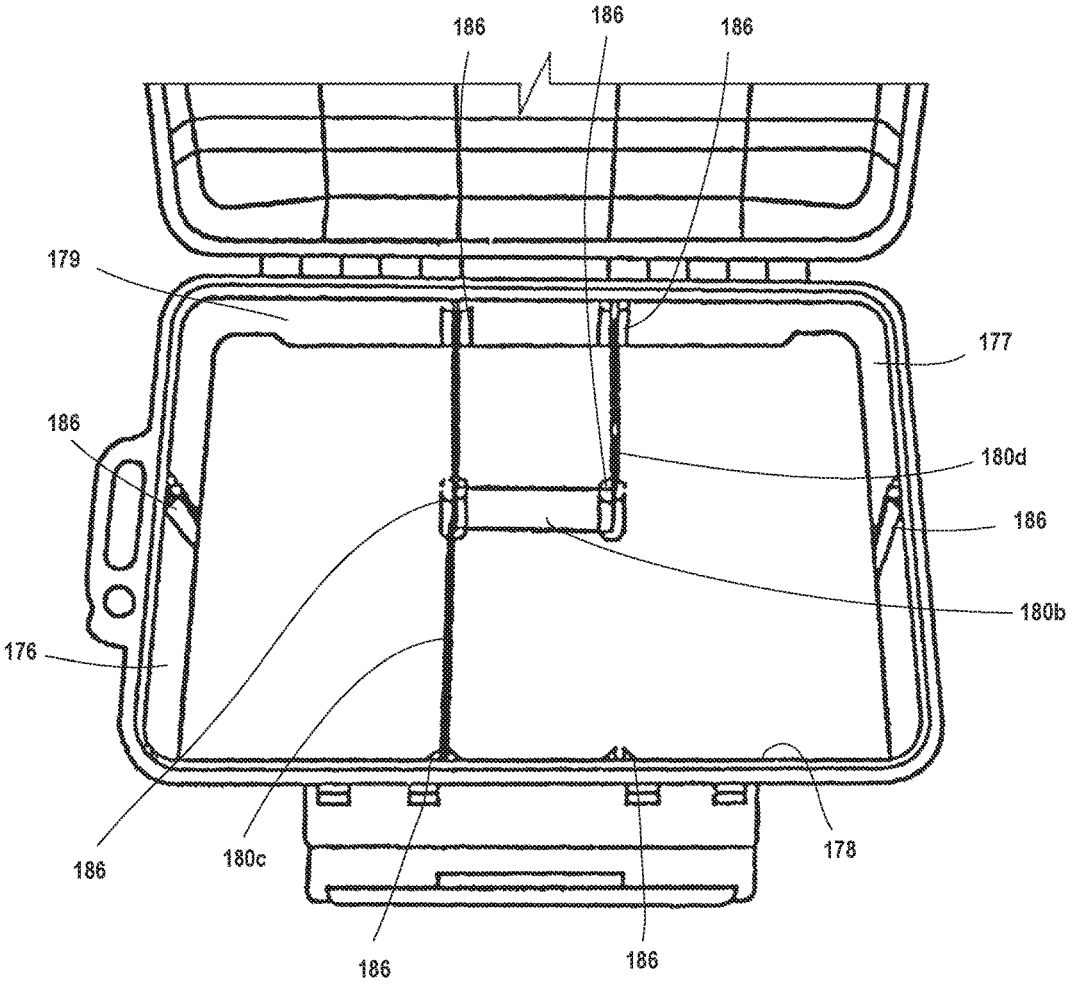
FIG. 38 is a top view a waterproof container in the open position with dividers in an arrangement as described herein.
Figure 39:
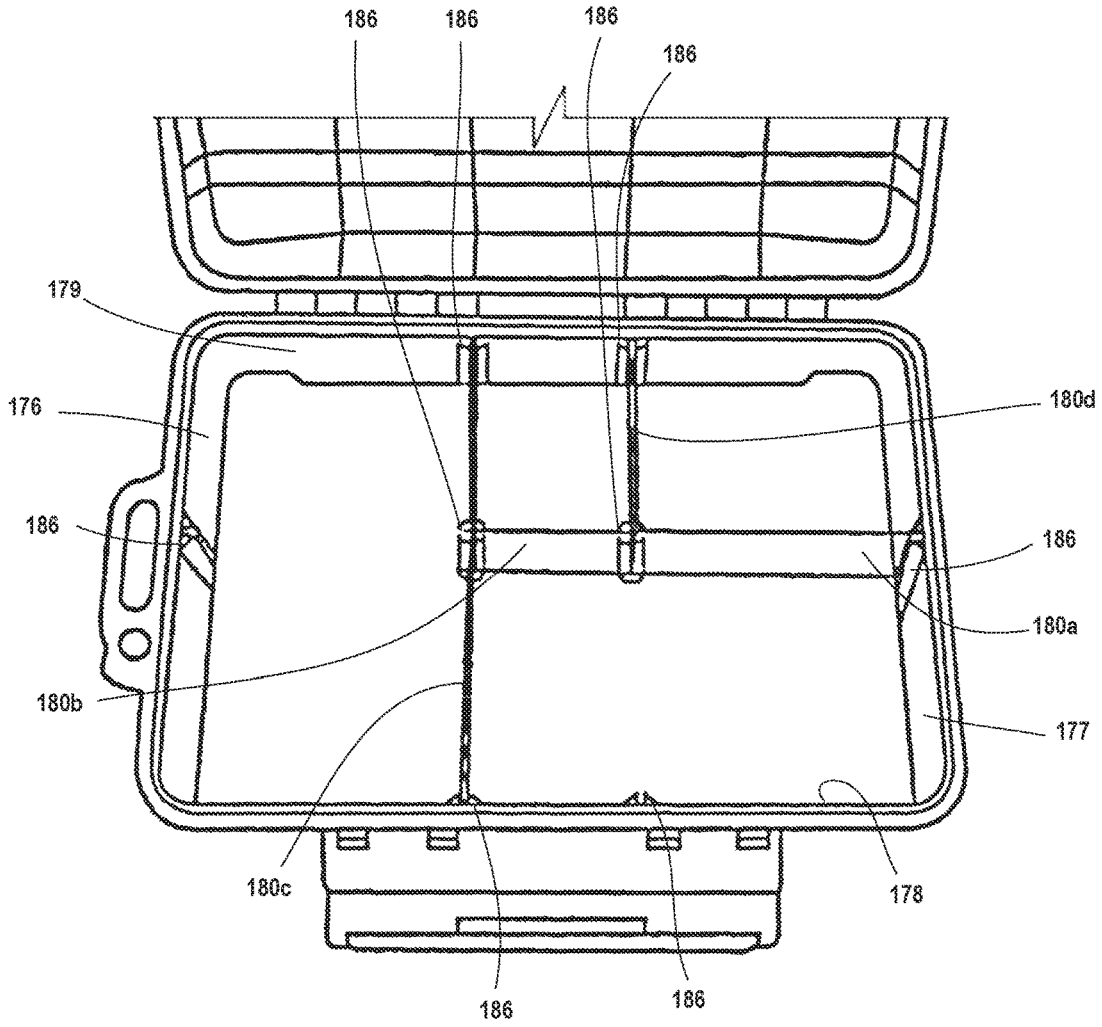
FIG. 39 is a top view a waterproof container in the open position with dividers in an arrangement as described herein.
Figure 40:
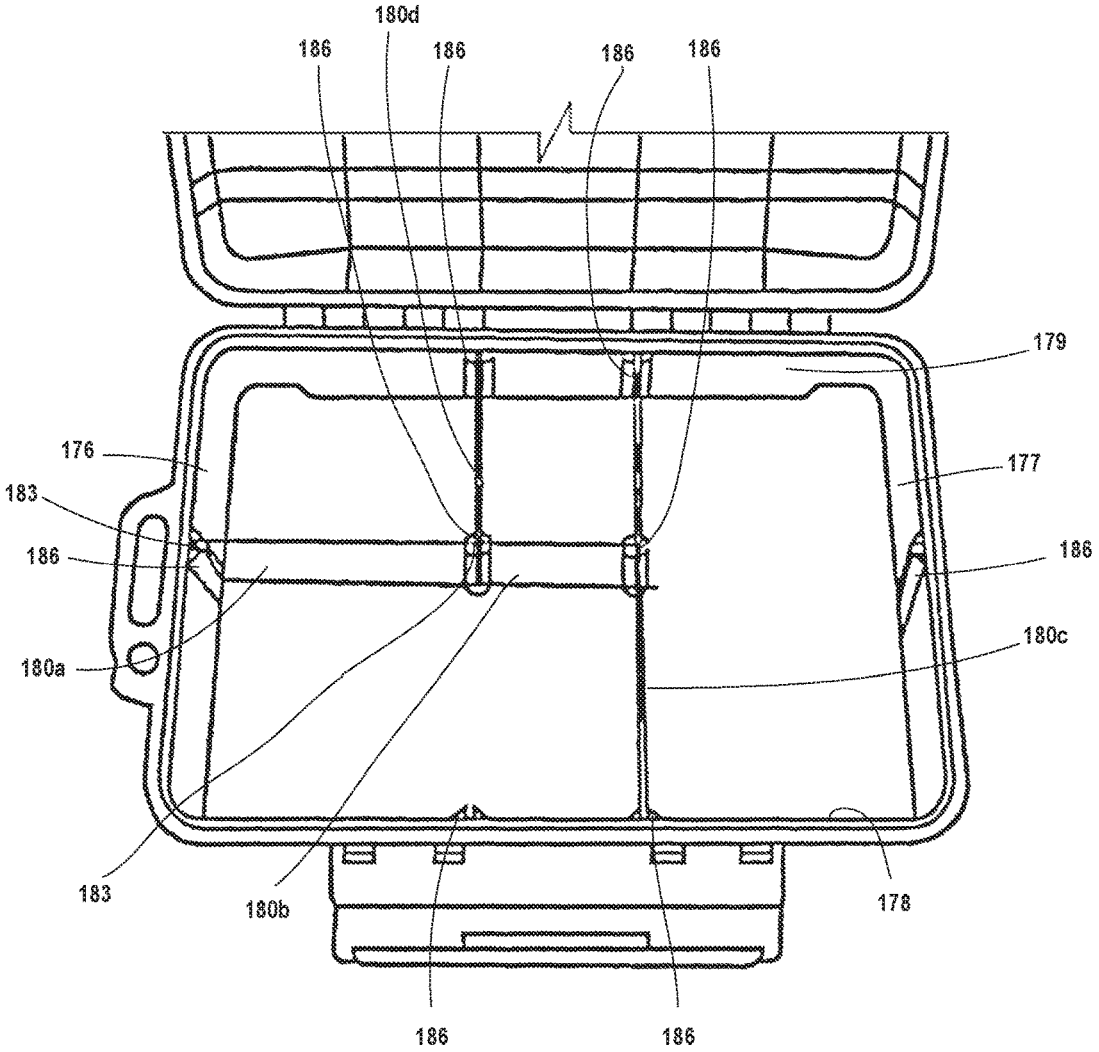
FIG. 40 is a top view a waterproof container in the open position with dividers in an arrangement as described herein.
Figure 41:
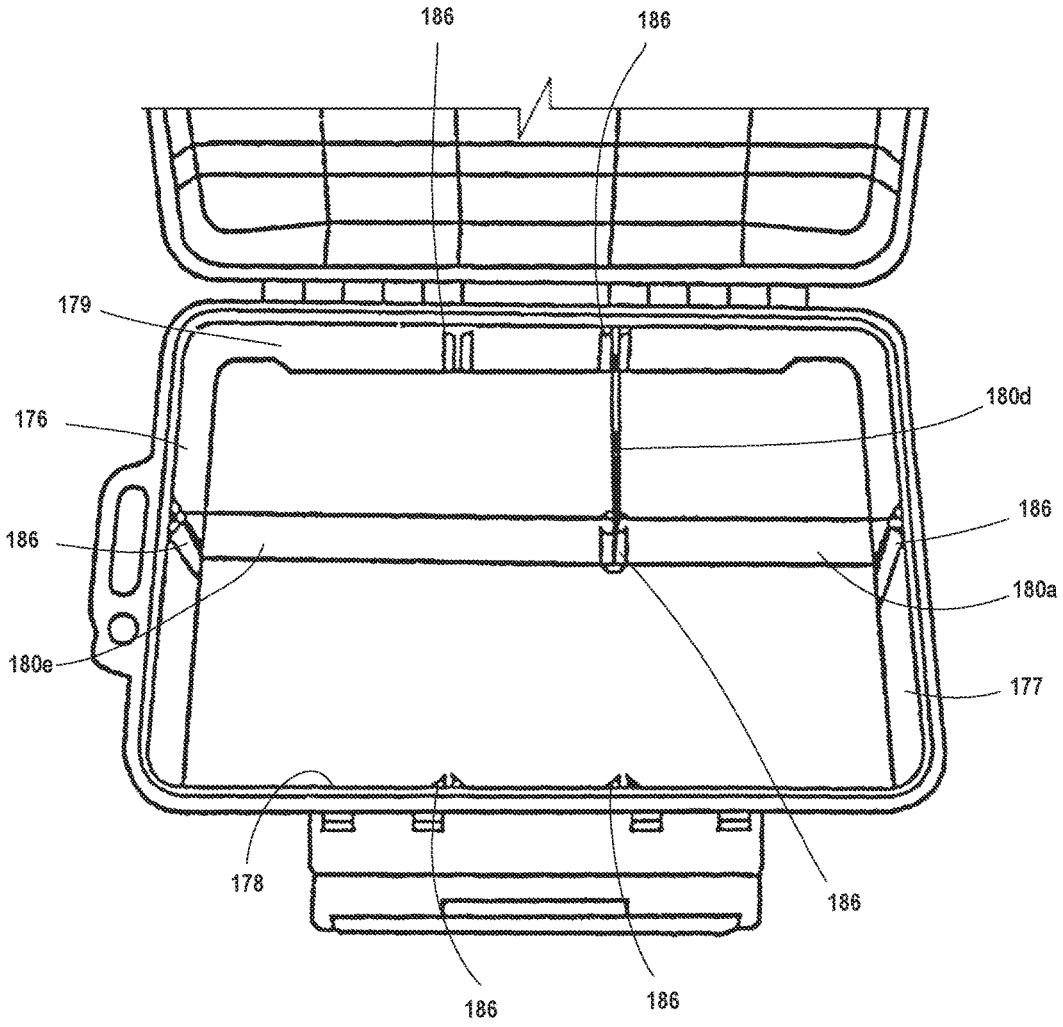
FIG. 41 is a top view a waterproof container in the open position with dividers in an arrangement as described herein.
Figure 42:
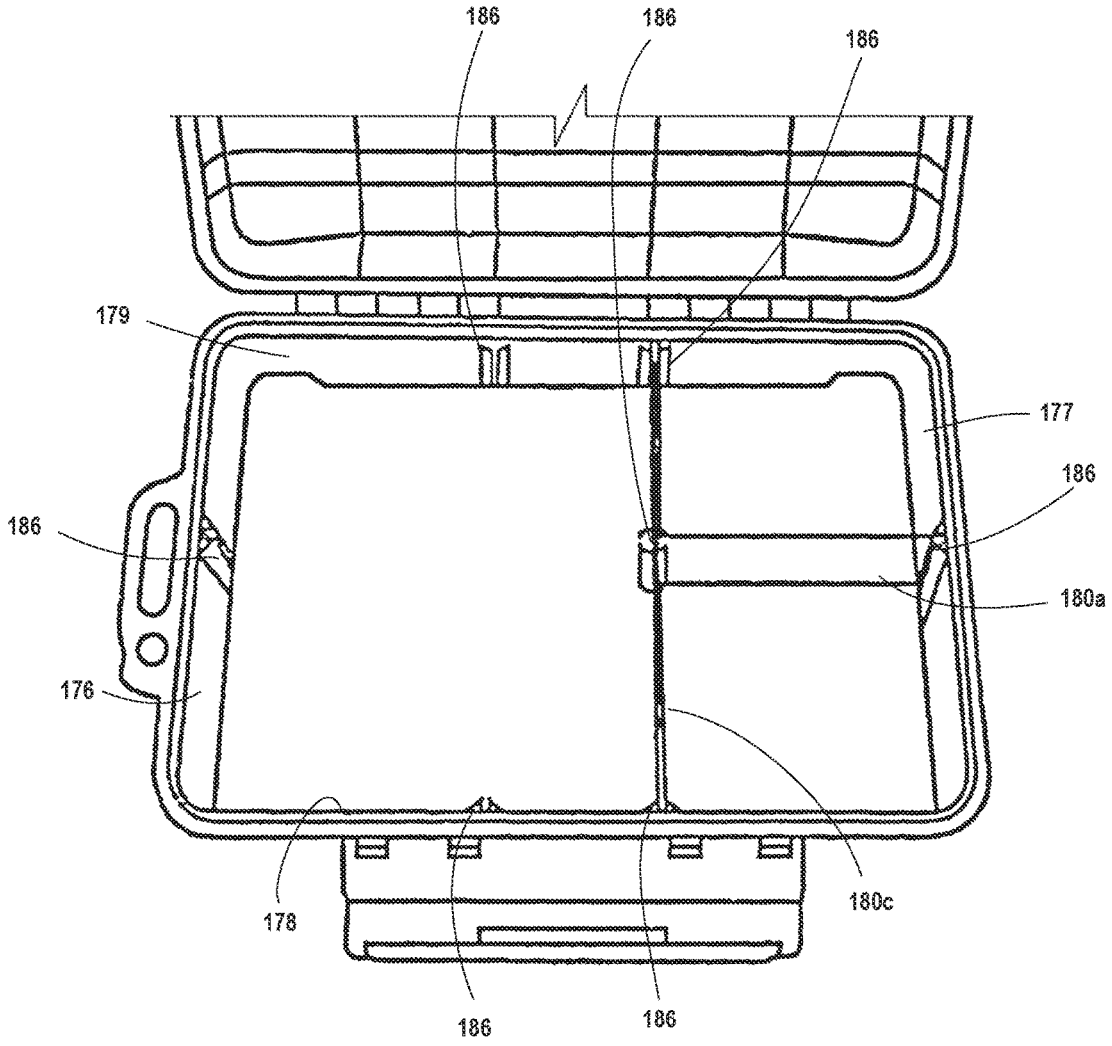
FIG. 42 is a top view a waterproof container in the open position with dividers in an arrangement as described herein.
Figure 43:
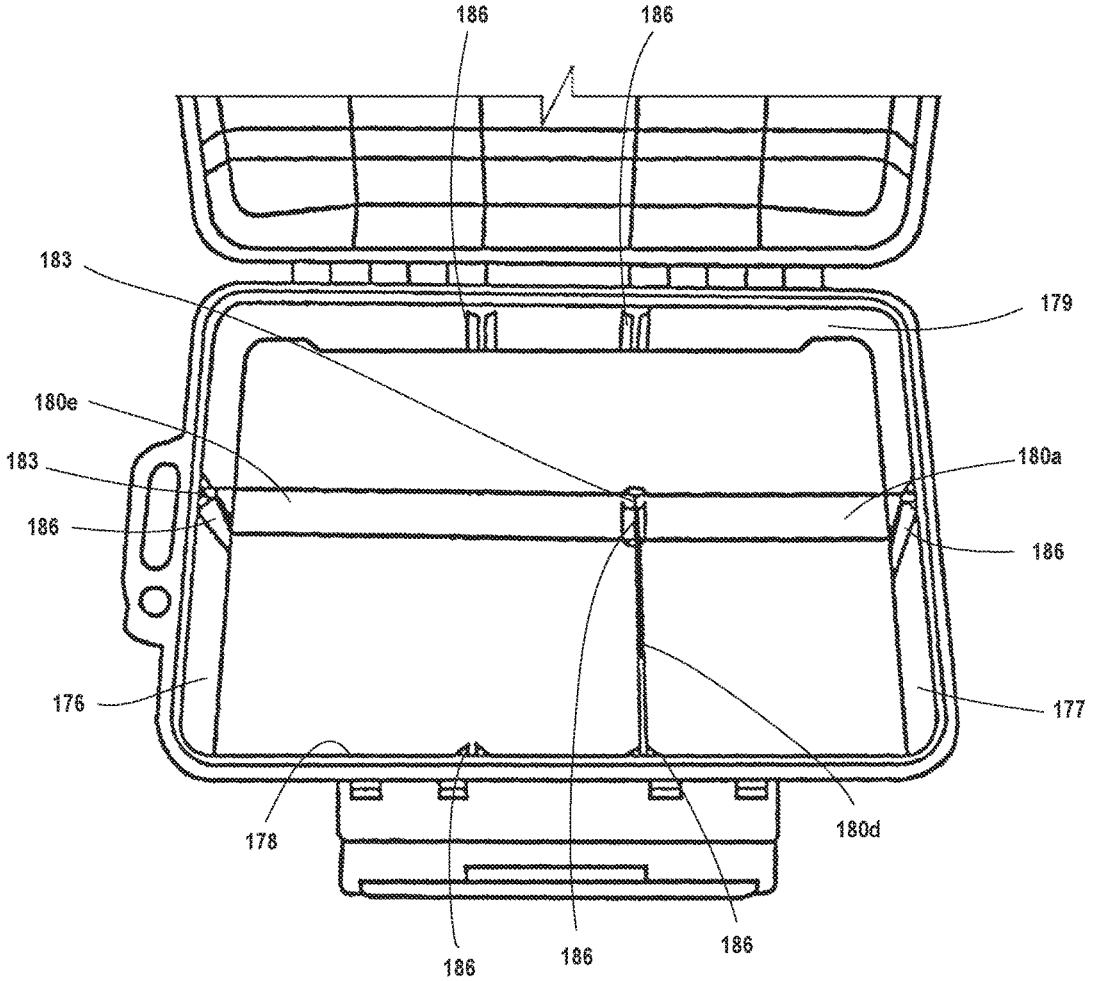
FIG. 43 is a top view a waterproof container in the open position with dividers in an arrangement as described herein.
Figure 44:
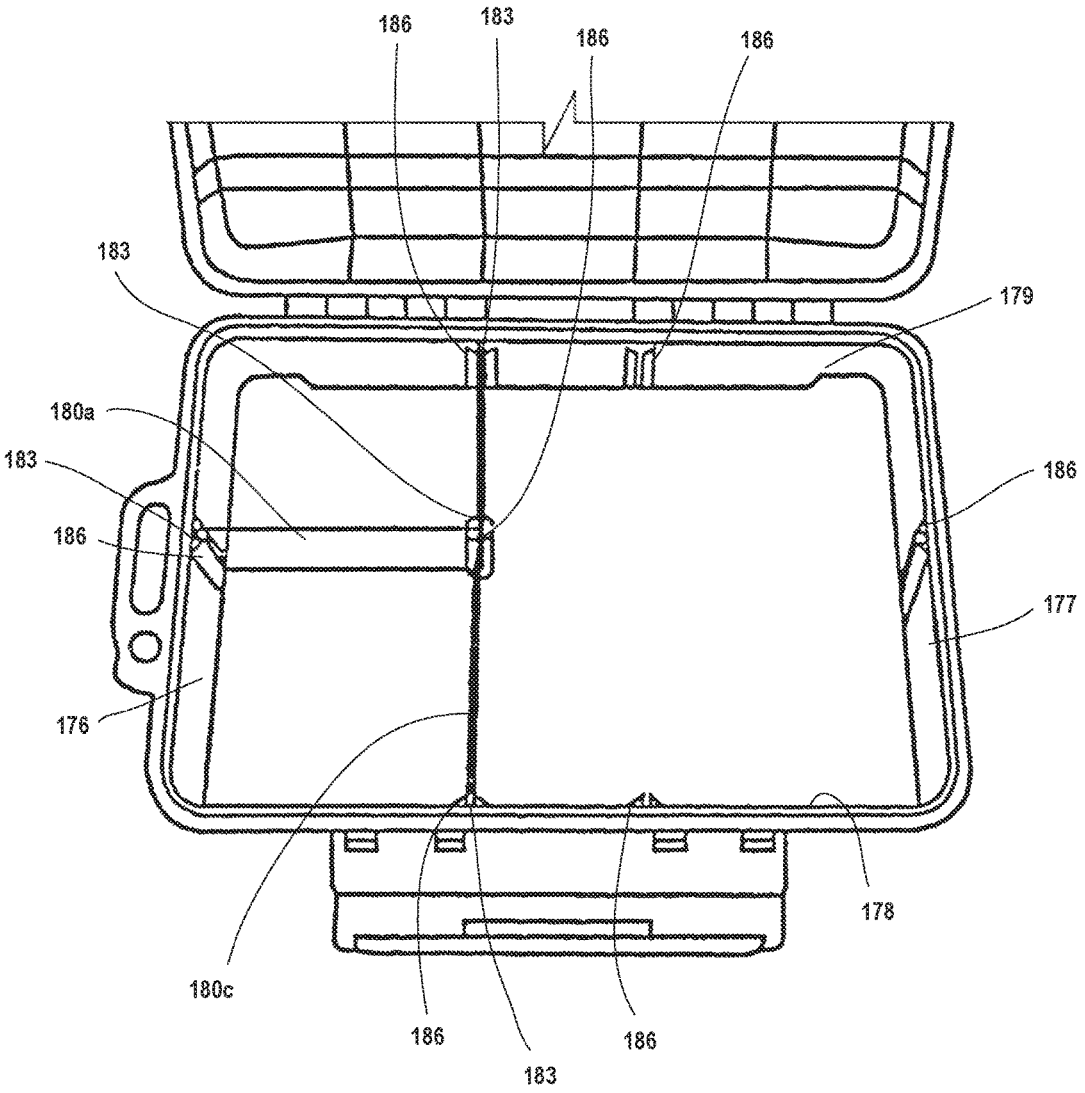
FIG. 44 is a top view a waterproof container in the open position with dividers in an arrangement as described herein.
Figure 45:
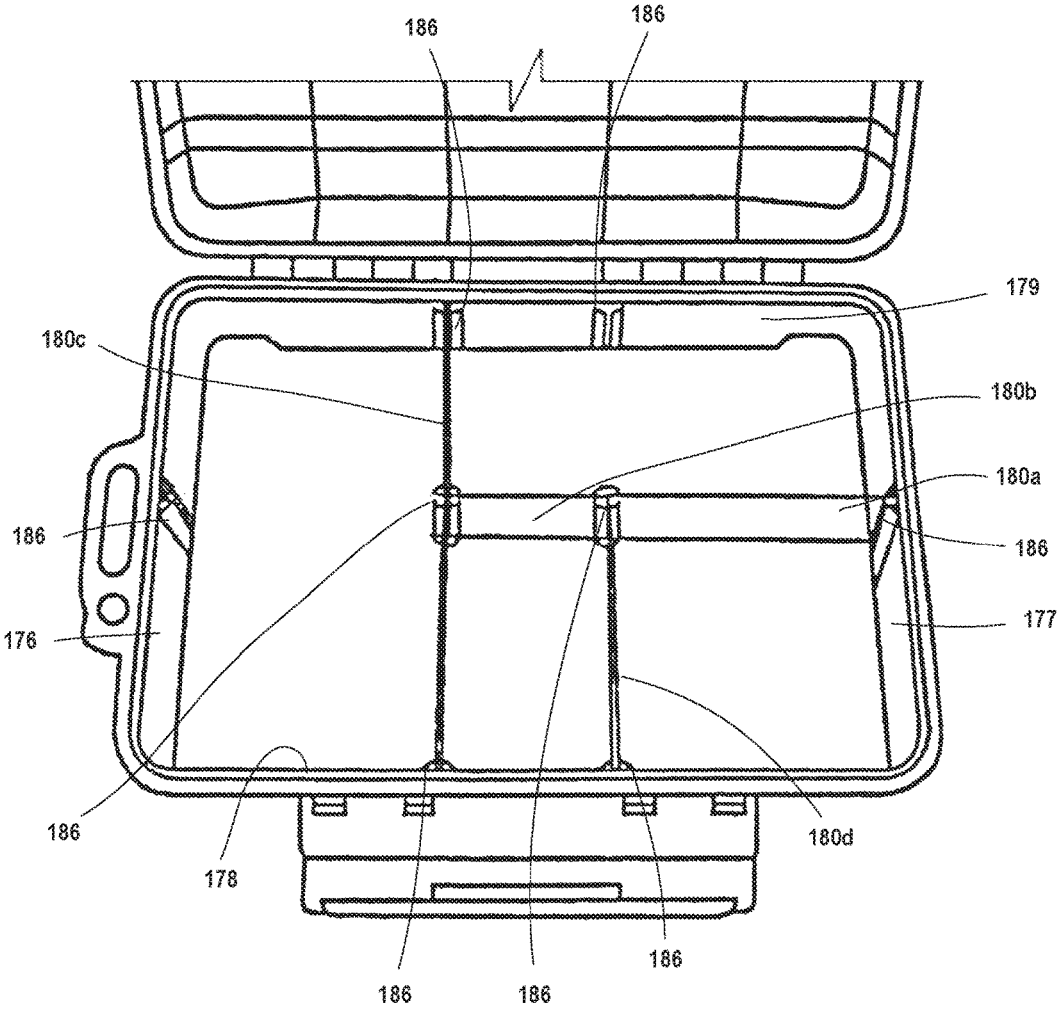
FIG. 45 is a top view a waterproof container in the open position with dividers in an arrangement as described herein.
Figure 46:
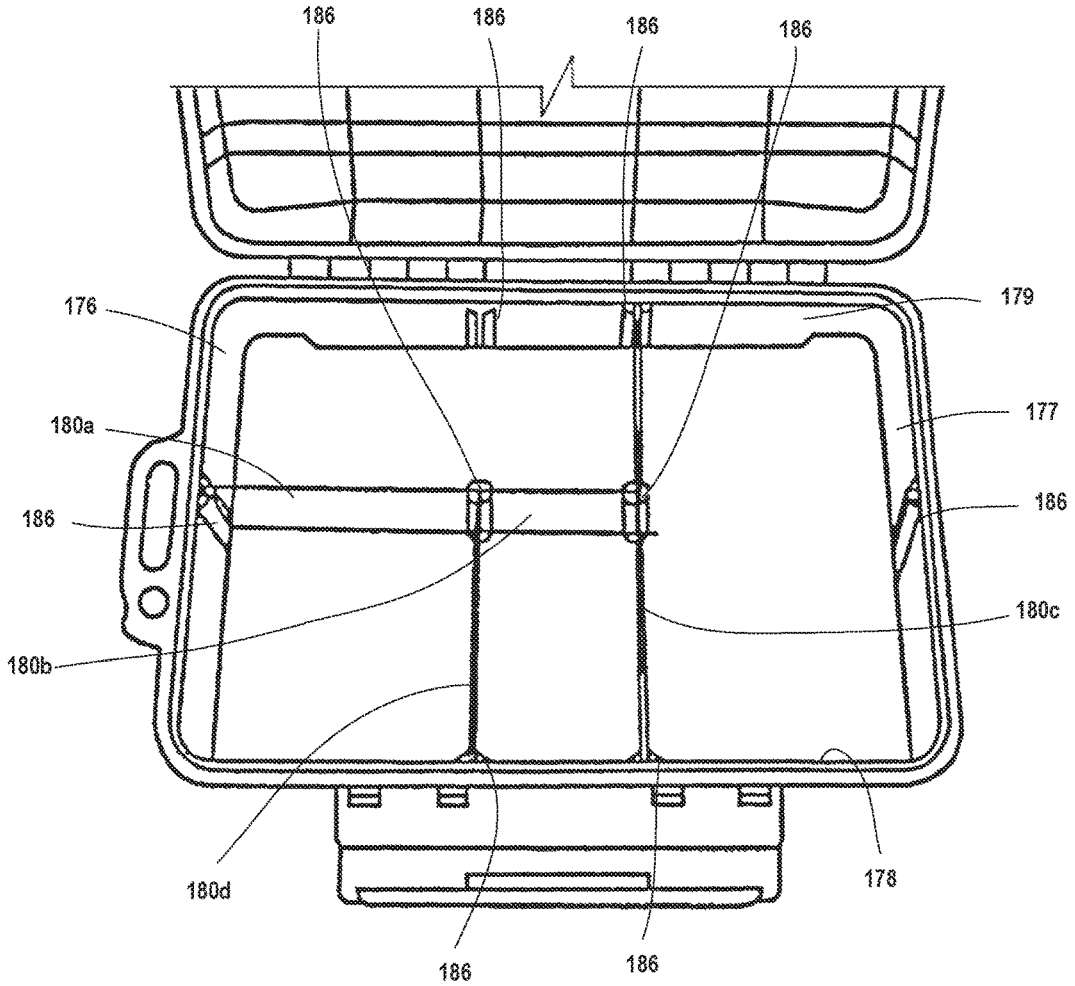
FIG. 46 is a top view a waterproof container in the open position with dividers in an arrangement as described herein.
Figure 47:
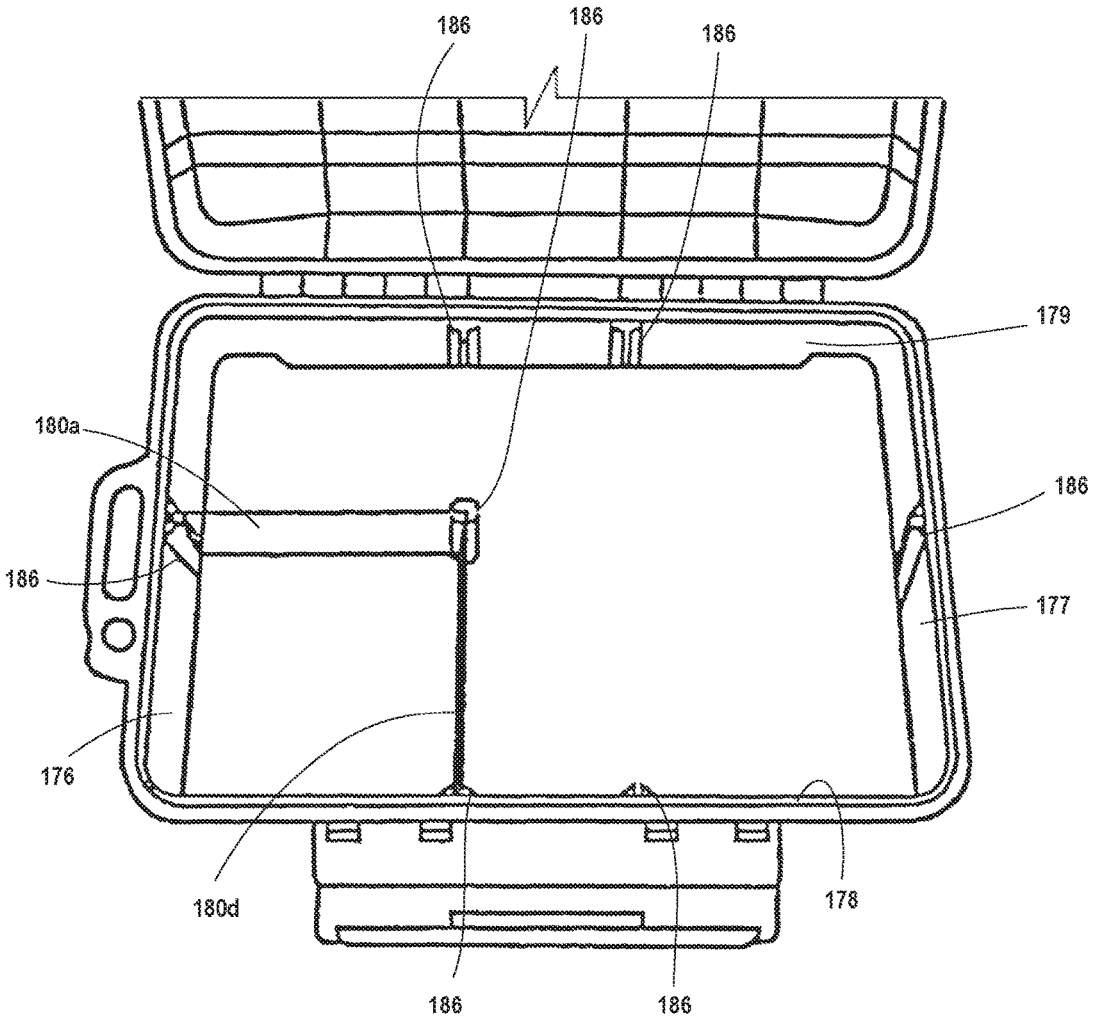
FIG. 47 is a top view a waterproof container in the open position with dividers in an arrangement as described herein.
Figure 48:
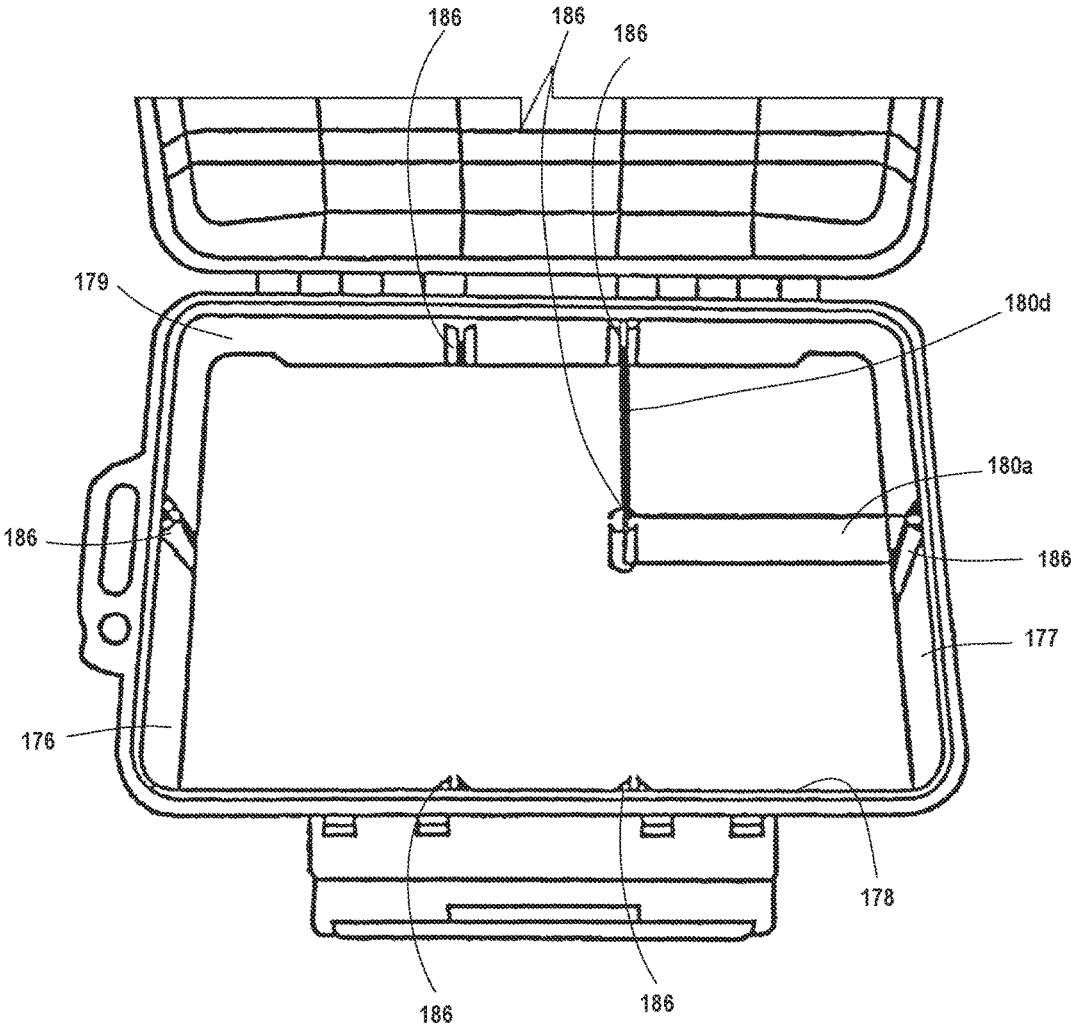
FIG. 48 is a top view a waterproof container in the open position with dividers in an arrangement as described herein.
Figure 49:
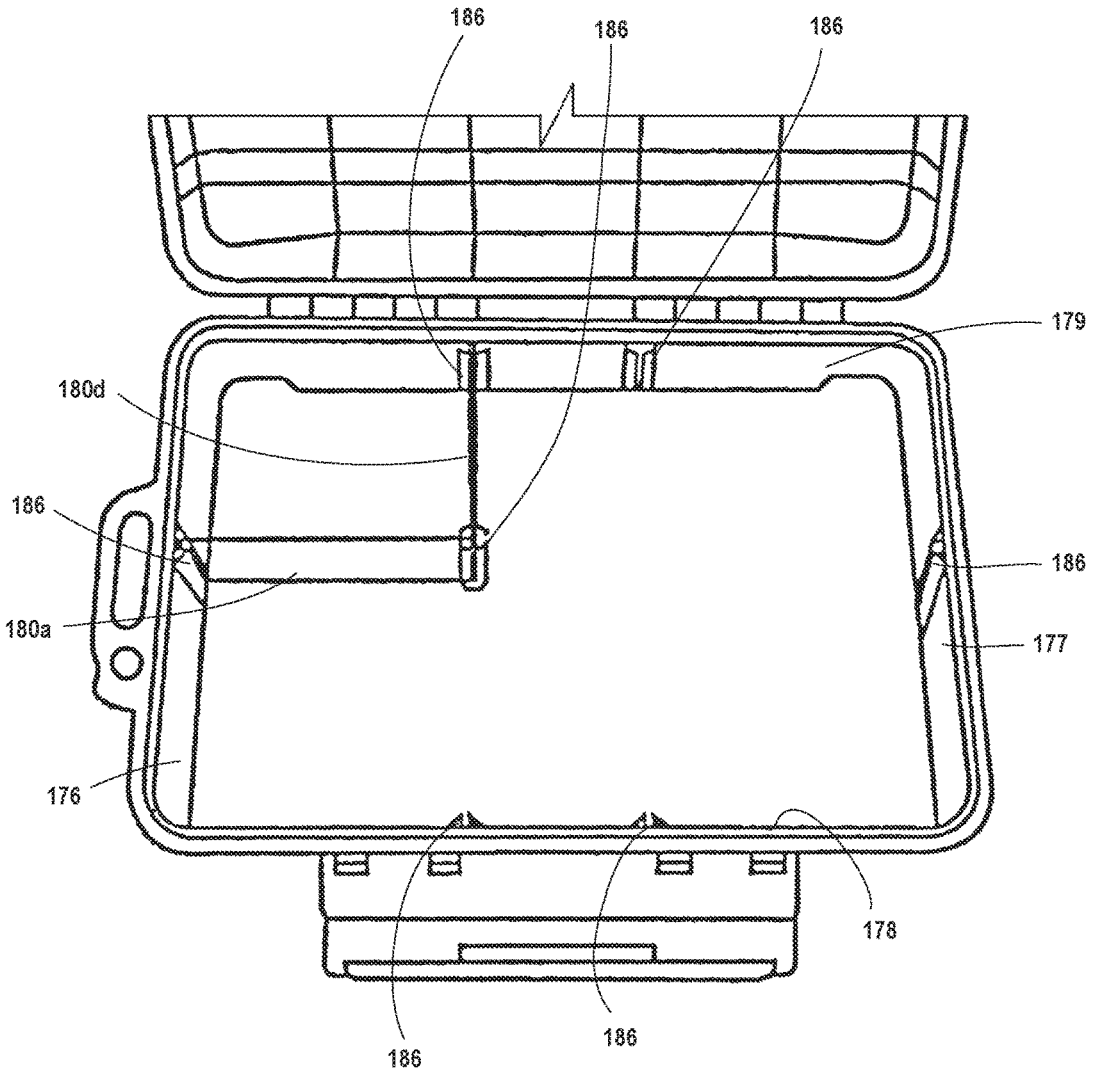
FIG. 49 is a top view a waterproof container in the open position with dividers in an arrangement as described herein.
Figure 50:
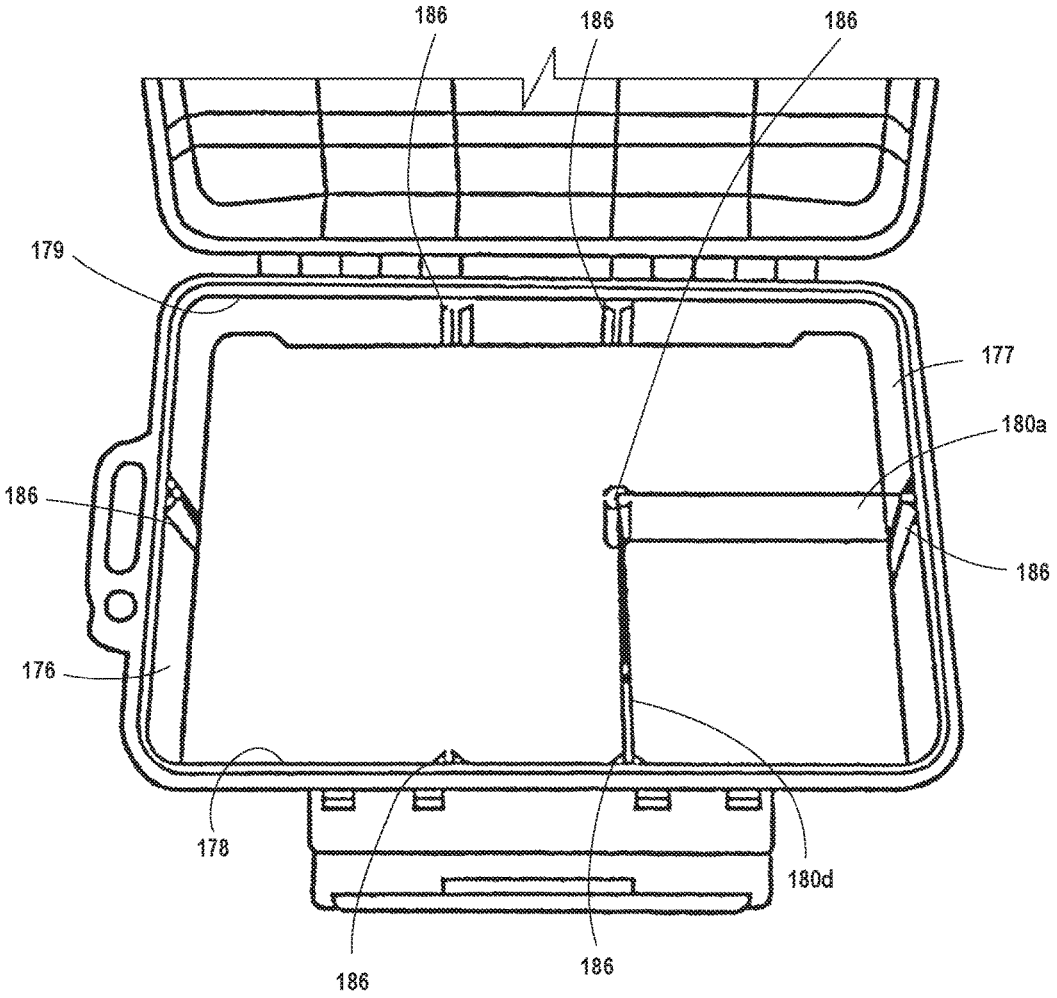
FIG. 50 is a top view a waterproof container in the open position with dividers in an arrangement as described herein.

In some embodiments, such as the one shown in FIGS. 13, 15 and 18, a divider 180 can include engaging portions in the form of first and second flared edges 183 opposite one another. As shown in FIG. 19, the walls (e.g., 176 or 178) can also include a coupling member in the form of a first track 186 for slidably engaging with the flared edge 183 of the removable divider 180 (e.g. 180*c*), and an opposing wall (e.g., 177 or 179) can include a coupling member in the form of a second track 186 for slidably engaging with the second flared edge 183 of the removable divider 180. The tracks 186 on the walls 176-179 can be provided on the interior wall(s) of the second shell 14. The first and second tracks 186 can be oriented to extend perpendicular to the base 80, 82 of the shell 12, 14.

Figure 12:
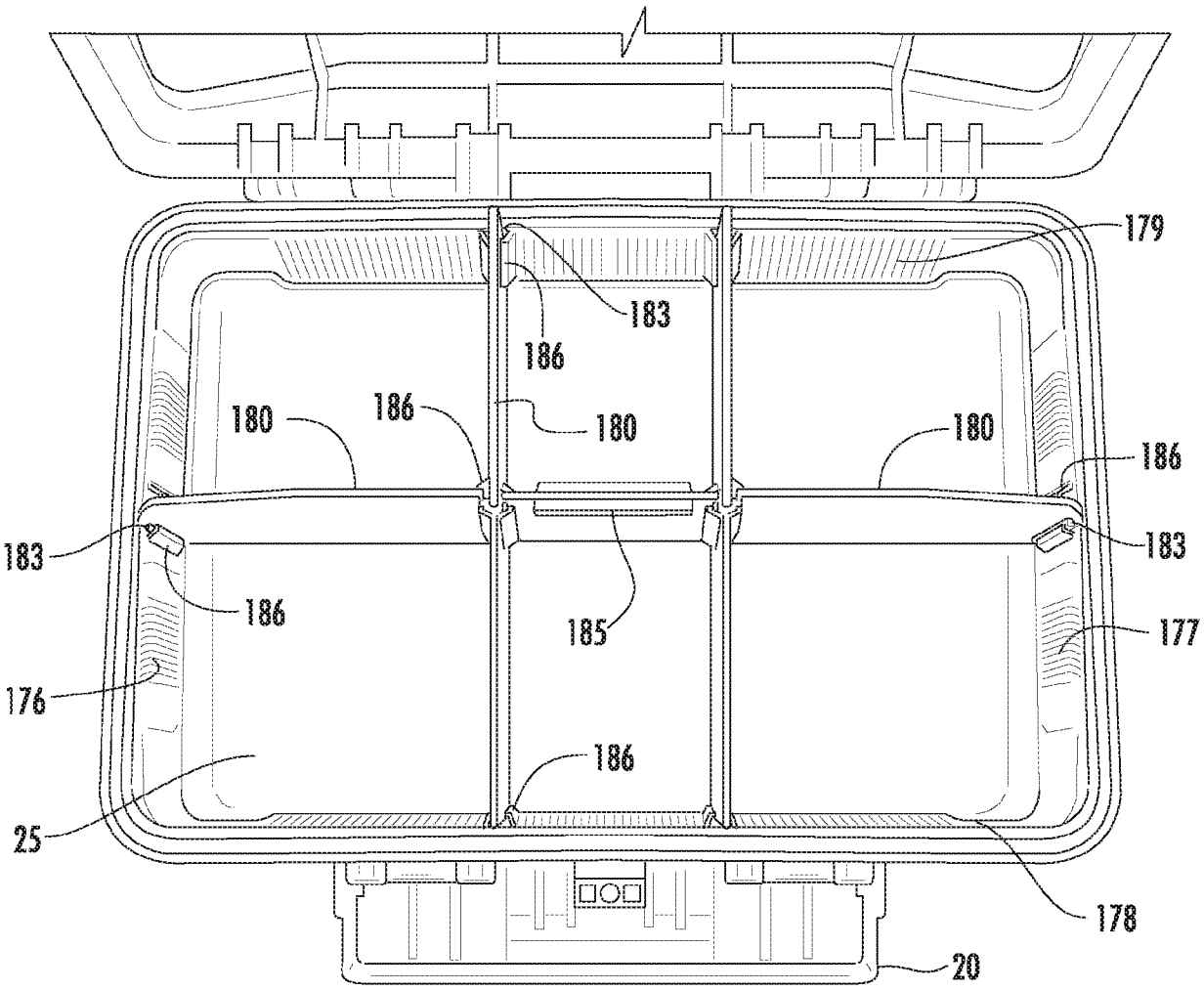
FIG. 12 is a top view of a waterproof container as described herein in the open position, so the interior is visible.
Figure 14:
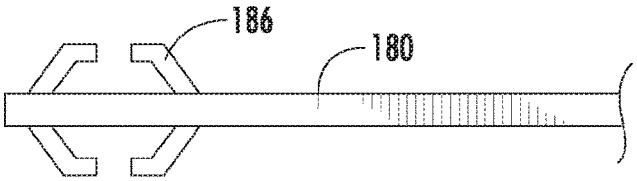
FIG. 14 is a top view of a divider with a track as described herein.

In some embodiments, such as the one shown in FIGS. 13 & 14, a divider 180 can include a coupling member 186. The coupling member 186 can be positioned at an end of the divider 180, as shown in FIG. 14, or at an intermediate portion of the divider 180, as shown in FIG. 13. As shown in FIG. 12-14 in some embodiments, the coupling member can include tracks 186. In some embodiments, the tracks 186 can be formed by a pair of legs with a cross-section of an isosceles triangle with the top cut off, while the engagement portion 183 can resemble a T-shape. As best shown in FIG. 15, the top of the T can be adapted to fit within the track 186 toward the base of the triangular cross-section. The inventor has discovered that this configuration greatly reduces the likelihood that the divider 180 will pull out of the track 186 even when significant forces are applied tangent to the length of the divider 180. Although engagement portion 183 is generally used to refer to the T-shaped element or similar projection or edge, and coupling member 186 is used to refer to the corresponding track or receiving structure, it should be understood that this arrangement can be reversed and that other geometries for releasable engagement are possible.

In some embodiments, such as the one shown in FIG. 18, a plurality of dividers 180 can be provided. The dividers 180 can include various sizes and/or various shapes (e.g., 180*a*, 180*b*, 180*c*, 180*d*, 180*e*). For example, some of the dividers 180 (e.g. 180*c*) can extend from one opposing lateral wall (e.g. a front wall 178) to another (e.g. a back wall 179). Other dividers 180 can extend from one opposing side wall 176 to another 177. Other dividers 180 (e.g. 180*a*, 180*c*, 180*d*, 180*e*) can have a length less than the distance from opposing sidewalls 176, 177 or opposing lateral walls 178, 179. In some embodiments, the dividers 180 can include generally rectangular shapes, generally square shapes, one or more angled corners, other polygonal shapes, and combinations thereof. As described above, the dividers can include one or more engaging portions 183, for example at one end of both ends of the divider 180. At least a portion of the plurality of dividers 180 can also include coupling members 186 on one or both faces of the divider (e.g. 180*b*) and/or proximate an end of the divider (e.g. 180*d*) for slidably engaging with the engaging portions 183 of one or more of the other dividers (e.g. 180*a*, 180*e*), as shown in FIGS. 12-15.

In some embodiments, the plurality of dividers 180 can be removably mounted within the interior of the container 10 in numerous configurations, such as the ones shown in FIGS. 19-50. In one embodiment, the container 10 can include at least two spaced-apart sets of coupling members 186 on an interior of the opposing lateral walls 178, 179, at least one set of coupling members 186 on an interior of each side wall 176, 177, and a set of coordinating dividers 180. The sets of coupling members 186 can be positioned such that a line drawn between a set of coupling members 186 is parallel to either the lateral walls 178, 179 or the side walls 176, 177.

The set of coordinating dividers 180 are configured to align and engage with each other and/or the coupling members 186 on the walls 176-179 in various configurations. All of the coordinating dividers 180 or only a portion of the set 180 can be used in certain configurations. In some embodiments as shown in FIG. 18, a set of coordinating dividers 180*a-e* can be provided with the container 10, but not all of the dividers 180*a-e* are designed to be inserted at the same time.

As shown in FIG. 18, a set of seven coordinating dividers 180 can be provided. The set can include two long longitudinal dividers 180*c* that can extend from one opposing lateral wall to the other 178-179. Each long longitudinal divider 180*c* can include an engagement portion 183 at each end of the divider 180*c* and a coupling member 186 at a middle portion of each face. The engagement portions 183 of the long longitudinal divider 180*c* can align with and be removably mounted to opposing coupling members 186 on opposing lateral walls 178, 179.

The set can also include one short longitudinal divider 180*d* that can extend only a portion of the distance between opposing lateral walls 178, 179, for example half of the distance between opposing lateral walls 178, 179. The short longitudinal divider 180*d* can include an engagement portion 183 on one end and a pair of coupling members 186 at the other end. The engagement portion 183 on the short longitudinal divider 180*d* can be removably mounted to coupling members 186 on a lateral wall 178, 179 or a side wall 176, 177. The coupling members 186 of the short longitudinal divider 180*d* can align with the coupling members 186 of the side walls 176, 177 when the short longitudinal divider 180*d* is mounted to the coupling members 186 of the lateral walls 178, 179.

The set can also include two short lateral dividers 180*a* that can extend only a portion of the distance between opposing side walls 178, 179. Each short lateral divider 180*a* can include an engagement portion 183 on each end of the divider 180*a*. The engagement portion 183 of the short lateral divider 180*a* can align with and be removably mounted to a coupling member 186 on a wall 176-179 and a coupling member 186 on one of the other dividers (e.g. 180*c*, 180*d*). The coupling members 186 on a short lateral divider 180*a* can align with the coupling members 186 of the lateral walls 178, 179 when the short lateral divider 180*a* is mounted to the coupling members 186 of the side walls 176, 177.

The set can also include one middle lateral divider 180*b* having a length about equal to the distance between the two coupling members 186 on a lateral wall 178 or 179. The middle lateral divider 180*b* can include an engagement portion 183 on each end of the divider 180*b*. The engagement portions 183 of the middle lateral divider 180*b* can align with and be removably mounted to coupling members 186 on the longitudinal dividers (e.g. 180*c* and 180*c*, or 180*d* and 180*c*) when the longitudinal dividers are attached to the coupling members 186 of the lateral walls 178, 179.

The set can also include one long lateral divider 180*e* having a length about equal to the sum of lengths of the middle lateral divider 180*b* and one short lateral divider 180*a*. In some embodiments, the long lateral divider 180*e* does not extend the full distance between the side walls 179, 177. The long lateral divider 180*e* can include an engagement portion 183 on each end of the divider 180*e*. The engagement portions 183 of the long lateral divider 180*e* can align with and be removably mounted to a coupling member 186 on a wall 176-179 and a coupling member 186 on one of the other dividers (e.g. 180*c*, 180*d*), for example as shown in FIGS. 35, 36, 41 and 43. For example, the coupling member 186 on the long lateral divider 180*e* can align with coupling members 186 of the lateral walls 178, 179 when the long lateral divider 180*e* is mounted to the coupling members 186 of the side walls 176, 177. In embodiments with two sets of coupling members 186 on each lateral wall 178, 179, the coupling member 186 on the long lateral divider 180*e* can align with the coupling member 186 of the lateral wall 178, 179 that is further from the side wall 176, 177 to which the divider 180*e* is mounted.

The set of coordinating dividers 180*a-e* can form 32 different storage configurations, including the ones shown in FIGS. 19-50. Examples of features of the dividers (180*a*, 180*b*, 180*c*, 180*d*, 180*e*) used in FIGS. 19-50 are shown in more detail in FIG. 18. For example, three of the dividers (180*a*, 180*c*, and 180*d*) can be removably mounted in the container 10 for the configuration shown in FIG. 19, with one long longitudinal divider 180*c* mounted to opposing coupling members 186 on walls 179, 178, the short longitudinal divider 180*d* mounted to the other coupling member 186 on wall 178, and one short lateral divider 180*a* mounted to the coupling member 186 on wall 176 and the coupling member 180 on divider 180*a*. Although not shown in FIGS. 19-50, coupling portions 183 on the ends of the dividers 180 can slidably engage with the coupling members 186 to removably mount the dividers 180 in the container 10 as shown in FIGS. 12-15. In another example, five of the dividers (180*a*, 180*a*, 180*b*, 180*c* 180*c*) can be removably mounted in the container 10 for the configuration shown in FIG. 34, with one long longitudinal divider 180*c* mounted to opposing coupling members 186 on walls 179, 178, the other long longitudinal divider 180*c* mounted to opposing coupling members 186 on walls 179, 178, the middle lateral divider 180*b* mounted to the coupling members 186 on the inner faces of the two long longitudinal dividers 180*c*, 180*c*, one short lateral divider 180*a* mounted to the coupling members 186 on the wall 176 and the outer face of the first long longitudinal divider 180*c*, and the other short lateral divider 180*a* mounted to the coupling members 186 on the wall 177 and the outer face of the second long longitudinal divider 180*c*. A similar configuration showing the engaging portions 183 and coupling members 186 is also shown in FIG. 12. In another example, three of the dividers (180*e*, 180*d*, 180*a*) can be removably mounted in the container 10 for the configuration shown in FIG. 41, with the short longitudinal divider 180*d* mounted to a coupling member 186 on wall 179, the long lateral divider 180*e* mounted to the coupling members 186 on wall 176 and the end of divider 180*d*, and one short lateral divider 180*a* mounted to the coupling members 186 on wall 177 and the end of divider 180*d*. Additional details of the set of dividers 180 and various configurations are provided by the FIGS. 18-50 in conjunction with the descriptions of the container 10 and dividers 180*a-e* above.

Such an arrangement allows a user to customize the configuration of the container 10, including the size of storage compartments, to best serve the user's needs and further provides flexibility to adjust the storage organization for different applications in the future. The system of engaging portions 183 and corresponding coupling members 186 on the dividers 180 and/or container walls 176-179 secure the dividers 180 in place within the storage volume 22 of the container 10 for each configuration.

The foregoing is provided for purposes of illustrating, explaining, and describing embodiments of this invention. Modifications and adaptations to these embodiments will be apparent to those skilled in the art and may be made without departing from the scope or spirit of this invention.

What is claimed is:

1. A container comprising:

a first shell and a second shell, a first rim extending around said first shell, a second rim extending around said second shell, and a latch for securing the first shell to the second shell in a mated position, wherein an enclosed storage volume is defined by said first shell and said second shell in the mated position, wherein the first shell comprises a grip projection adapted for opening said container from a mated position, wherein said latch defines a latch recess, said latch recess receiving said grip projection when the latch secures the first shell to the second shell in the mated position, wherein said first rim and said second rim form a seal, said seal comprising a first side comprising a continuous recess, having a pair of continuous sides and a seal ridge between, but spaced apart from, said continuous sides, and a second side comprising inner and outer continuous sealing ridges, wherein both continuous sealing ridges are between the continuous sides and on opposite sides of the seal ridge in the mated position, wherein the latch comprises a pivot assembly and a primary assembly, wherein the pivot assembly is rotatably coupled to both said second shell and said primary assembly, and wherein said primary assembly is adapted to engage said first rim, and wherein said first rim comprises an elongated retention ridge extending laterally along front portion of the first rim, wherein an upper portion of said primary assembly comprises a laterally-extending, clamping ridge, wherein said clamping ridge extend over said retention ridge to lock said first shell to said second shell when the latch is in a locked position.

2. The container according to claim 1, wherein the seal ridge is part of a seal that extends along a bottom of the continuous recess.

3. The container according to claim 2, wherein the inner and outer sealing ridges form an interference fit with the seal when the first shell and the second shell are in the mated position.

4. The container according to claim 1, wherein the seal ridge is formed of a resilient material.

5. The container according to claim 4, wherein the inner and outer continuous sealing ridges are formed of a rigid material.

6. The container according to claim 5, wherein the inner and outer continuous sealing ridges are integrally formed with the first shell.

7. The container according to claim 1, wherein the inner and outer continuous sealing ridges have a generally triangular cross-section, while the seal ridge has a generally U-shaped cross-section.

8. The container according to claim 1, wherein the first and second shells are hingedly coupled at a rear side, for rotating between an open position and a closed position.

9. The container according to claim 8, wherein said first and second shells are hingedly coupled by a pair of two hinges, said container further comprising an elongated, traversing element extending between the hinges, wherein said elongated, traversing element is spaced apart from the first and second rims.

10. The container according to claim 1, further comprising at least one support projection extending from a rear of said container, said at least one support projection for supporting said container in a vertical orientation.

11. The container according to claim 10, wherein at least one support projection comprises a support projection orifice adapted for receiving a body of a carabineer.

12. The container according to claim 1, wherein said pivot assembly comprises a left pivot assembly and a right pivot assembly, which are coupled to first and second shell pivot mounts of the second shell.

13. The container according to claim 1, wherein said latch defines a latch recess, and wherein said latch recess receives the pivot assembly when the latch secures the first shell to the second shell in the mated position.

14. The container according to claim 1, wherein said primary assembly comprises a support leg adapted to rest against an outside surface of said second shell when the latch secures the first shell to the second shell in the mated position.

15. The container according to claim 1, further comprising a plurality of coupling members on an interior surface of the second shell for engagement with one or more removable dividers.

16. The container according to claim 15, further comprising a plurality of dividers for removable mounting within the container, wherein each of said dividers comprises at least one engaging portion corresponding to said coupling members.

17. The container according to claim 1, further comprising at least three dividers for removable mounting within the container, wherein each divider has a different configuration and each comprises at least one engaging portion and at least one coupling member.

18. The container according to claim 1, further comprising at least five dividers for removable mounting within the container, wherein each divider has a different configuration and each comprises at least one engaging portion and at least one coupling member.

19. A container comprising:

a first shell and a second shell, a first rim extending around said first shell, a second rim extending around said second shell, and a latch for securing the first shell to the second shell in a mated position, wherein an enclosed storage volume is defined by said first shell and said second shell in the mated position, wherein the first shell comprises a grip projection adapted for opening said container from a mated position, wherein said latch defines a latch recess, said latch recess receiving said grip projection when the latch secures the first shell to the second shell in the mated position, wherein said first rim and said second rim form a seal, said seal comprising a first side comprising a continuous recess, having a pair of continuous sides and a seal ridge between, but spaced apart from, said continuous sides, and a second side comprising inner and outer continuous sealing ridges, wherein both continuous sealing ridges are between the continuous sides and on opposite sides of the seal ridge in the mated position, wherein the seal ridge is formed of an elastomeric material, and wherein the inner and outer continuous sealing ridges are formed of a rigid material.

20. A container comprising:

a first shell and a second shell, a first rim extending around said first shell, a second rim extending around said second shell, and a latch for securing the first shell to the second shell in a mated position, wherein an enclosed storage volume is defined by said first shell and said second shell in the mated position, wherein the first shell comprises a grip projection adapted for opening said container from a mated position, wherein said latch defines a latch recess, said latch recess receiving said grip projection when the latch secures the first shell to the second shell in the mated position, wherein said first rim and said second rim form a seal, said seal comprising a first side comprising a continuous recess, having a pair of continuous sides and a seal ridge between, but spaced apart from, said continuous sides, and a second side comprising inner and outer continuous sealing ridges, wherein both continuous sealing ridges are between the continuous sides and on opposite sides of the seal ridge in the mated position, wherein the latch comprises a pivot assembly and a primary assembly, wherein the primary assembly is rotatably coupled to a first end of the pivot assembly and the second shell is rotatably coupled to a second end of the pivot assembly opposite the first end, and wherein said primary assembly is adapted to engage said first rim.

* * * * *